US007836840B2

(12) United States Patent
Ehrhardt et al.

(10) Patent No.: US 7,836,840 B2
(45) Date of Patent: Nov. 23, 2010

(54) SUBSEA CRYOGENIC FLUID TRANSFER SYSTEM

(75) Inventors: Mark E. Ehrhardt, Houston, TX (US); William S. Mathews, The Woodlands, TX (US); Dawn Rymer, Pearland, TX (US); W. Brett Wilson, Spring, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 1150 days.

(21) Appl. No.: 10/579,359

(22) PCT Filed: Sep. 7, 2005

(86) PCT No.: PCT/US2005/031970
§ 371 (c)(1),
(2), (4) Date: May 15, 2006

(87) PCT Pub. No.: WO2006/044053

PCT Pub. Date: Apr. 27, 2006

(65) Prior Publication Data

US 2007/0095427 A1 May 3, 2007

Related U.S. Application Data

(60) Provisional application No. 60/619,383, filed on Oct. 15, 2004.

(51) Int. Cl.
*B63B 22/02* (2006.01)

(52) U.S. Cl. ..... 114/230.13; 141/82; 141/231; 141/387; 441/5; 62/50.1

(58) Field of Classification Search ..... 141/1, 141/82, 231, 387, 388; 441/3–5; 62/50.1; 405/224.2, 224.3, 224.4; 114/230.1, 230.12, 114/230.13, 234
See application file for complete search history.

(56) References Cited

U.S. PATENT DOCUMENTS 3,568,737 A * 3/1971 Burns ..... 141/383
3,969,781 A * 7/1976 Reid, Jr. ..... 441/5

(Continued)

FOREIGN PATENT DOCUMENTS

FR 2770484 A1 5/1999

(Continued)

OTHER PUBLICATIONS

Witz, et al., "Offshore LNG transfer—a new flexible cryogenic hose for dynamic service", Offshore Technology Conference, May 3-6, 2004, pp. 1-15, OTC 16270, Houston, TX.

(Continued)

*Primary Examiner*—Gregory L Huson
*Assistant Examiner*—Jason K Niesz

(57) ABSTRACT

The current invention includes to systems and methods of transferring cryogenic fluids between two locations. More particularly, some embodiments of the invention are related to systems and methods of using cryogenic risers and rotatable connections for transferring cryogenic fluids, including liquefied natural gas, from an ocean going vessel to a second location. One embodiment of the invention includes a system for transporting a cryogenic fluid between a floating vessel and a second location. The system including a cryogenic riser, a submersible turret connector. The being riser adapted to allow the vertical position of the first end of the riser to be changed, the second end of the first riser located in a body of water and in fluid communication with the second location. The submersible turret connector connected to the first end of the first riser. The first connector adapted for releasably connecting to a first floating vessel located on the body of water so that a cryogenic fluid can be communicated between the first vessel and the first end of the first riser, the first connector being moored to the bottom of the body of water such that the vertical position of the first connector can be changed, and the first connector adapted to allow the first vessel to rotate around the first connector upon the surface of the body of water while the first vessel is connected to the first connector.

80 Claims, 6 Drawing Sheets

U.S. PATENT DOCUMENTS

| | | | | |
|---|---|---|---|---|
| 4,188,157 | A | 2/1980 | Vigander | |
| 4,718,459 | A | 1/1988 | Adorjan | |
| 4,826,354 | A | 5/1989 | Adorjan | |
| 5,025,860 | A | 6/1991 | Mandrin | |
| 5,044,297 | A * | 9/1991 | de Baan et al. | 114/293 |
| 5,305,703 | A | 4/1994 | Korsgaard | |
| 5,339,760 | A | 8/1994 | Korsgaard | |
| 5,380,229 | A | 1/1995 | Korsgaard | |
| 5,431,589 | A * | 7/1995 | Corona | 441/4 |
| 5,553,976 | A | 9/1996 | Korsgaard | |
| 5,628,657 | A | 5/1997 | Breivik et al. | |
| 5,651,708 | A | 7/1997 | Borseth | |
| 5,697,732 | A | 12/1997 | Sigmundstad | |
| 5,878,814 | A | 3/1999 | Breivik et al. | |
| 5,983,931 | A | 11/1999 | Ingebrigtsen et al. | |
| 6,003,603 | A | 12/1999 | Breivik et al. | |
| 6,094,937 | A | 8/2000 | Paurola et al. | |
| 6,517,290 | B1 | 2/2003 | Poldervaart | |
| 6,546,739 | B2 | 4/2003 | Frimm et al. | |
| 6,655,155 | B2 | 12/2003 | Bishop | |
| 6,692,192 | B2 | 2/2004 | Poldervaart | |
| 2002/0174662 | A1 | 11/2002 | Frimm et al. | |
| 2003/0226373 | A1 | 12/2003 | Prible et al. | |
| 2004/0115005 | A1 | 6/2004 | de Baan | |
| 2005/0039665 | A1 | 2/2005 | Wille et al. | |
| 2005/0042035 | A1 | 2/2005 | de Baan | |
| 2006/0048850 | A1 * | 3/2006 | Espinasse | 141/387 |

FOREIGN PATENT DOCUMENTS

| | | | |
|---|---|---|---|
| GB | 2328196 | A | 2/1999 |
| GB | 2382809 | A | 6/2003 |
| WO | WO 93/24732 | | 12/1993 |
| WO | WO 93/24733 | | 12/1993 |
| WO | WO 96/17777 | | 6/1996 |
| WO | WO 02/092423 | A1 | 11/2002 |
| WO | WO 2004/048191 | A1 | 6/2004 |
| WO | WO 2004/080790 | A2 | 9/2004 |
| WO | WO 2004/097285 | A1 | 11/2004 |

OTHER PUBLICATIONS

European Search Report No. 112118, dated Apr. 20, 2005, for U.S. Appl. No. 60/619,383, 6 pp.

PCT International Search Report and Written Opinion, mailed Feb. 14, 2006, for PCT/US05/31970, 7 pp.

* cited by examiner

SUBSEA CRYOGENIC FLUID TRANSFER SYSTEM

CROSS REFERENCE TO RELATED APPLICATIONS

This application is the National Stage of International Application No. PCT/US05/31970, filed 7 Sep. 2005, and claims the benefit of U.S. Provisional Application 60/619,383, filed 15 Oct. 2004.

FIELD OF THE INVENTION

The current invention is related to systems and methods of transferring cryogenic fluids between two locations. More particularly, some embodiments of the invention are related to systems and methods of using cryogenic risers and rotatable connections for transferring cryogenic fluids, including liquefied natural gas, from an ocean going vessel to a second location.

BACKGROUND

Large volumes of natural gas (i.e., primarily methane) are located in remote areas of the world. This gas has significant value if it can be economically transported to market. Where the gas reserves are located in reasonable proximity to a market and the terrain between the two locations permits, the gas is typically produced and then transported to market through submerged and/or land-based pipelines. However, when gas is produced in locations where laying a pipeline is infeasible or economically prohibitive, other techniques must be used for getting this gas to market.

A commonly used technique for non-pipeline transport of gas involves liquefying the gas at or near the production site and then transporting the liquefied natural gas to market in specially-designed storage tanks aboard transport vessels. The natural gas is cooled and condensed to a liquid state to produce liquefied natural gas ("LNG"). LNG is typically, but not always, transported at substantially atmospheric pressure and at temperatures of about −162° C. (−260° F.), thereby significantly increasing the amount of gas which can be stored in a particular storage tank on a transport vessel. Once an LNG transport vessel reaches its destination, the LNG is typically offloaded into other storage tanks from which the LNG can then be revaporized as needed and transported as a gas to end users through pipelines or the like. LNG has been an increasingly popular transportation method to supply major energy-consuming nations with natural gas.

Currently, all LNG transfer to and from LNG carrier ships at terminals is conducted with alongside, above water surface, cryogenic loading arms ("hard arms"), which consist of counterweighted hard-piped elements connected by swivels. A special connector, with emergency disconnect capability, is located at the end of the loading arm. This connector mates with the flange on the LNG carrier cargo manifold, typically located near amidships on the LNG carrier. As the LNG carrier must be moored alongside the berth to enable the loading arms to connect at the cargo manifold, the arrangement is known as alongside offloading/loading.

For offshore terminals, alongside, above water surface, offloading is typical. Marine versions of LNG loading arms are being designed with special swivels, stronger structural members, and specialized end connectors with targeting systems, all to enable connection and subsequent LNG transfer offshore. In these cases, the LNG carrier is typically moored alongside the terminal berth with nylon mooring lines and fenders to prevent damaging contact between the ship and berth structures. Although there are technical and operational aspects that require continued evaluation, marine alongside offloading is considered to be an extension of conventional LNG transfer technology.

In mild and moderate environments, offshore alongside offloading can achieve acceptable operability. However, as the severity of the environment increases, the portion of time that alongside berthing and offloading can take place decreases. Limiting factors include LNG carrier mooring line tensions and tug boat capabilities, as well as loading arm limits.

Alternatively, systems for transferring natural gas (in the gaseous state) through turrets, risers and subsea gas pipelines have been designed, licensed for operation, and are being built. Examples include the Excelerate "Energy Bridge" and Leif Hoegh/Hamworthy's Ship Regasification Vessel (SRV) concepts. The Energy Bridge and SRV concepts use disconnectable turrets. Additional background can be found in U.S. Pat. No. 5,983,931 to lngebrigtsen et al., U.S. Pat. No. 5,025,860 to Mandrin, U.S. Pat. No. 5,878,814 to Breivik et al., U.S. Pat. No. 6,003,603 to Breivik et al., U.S. Pat. No. 6,517,290 to Poldervaart, U.S. Pat. No. 6,546,739 to Frimm et al., WO 2004/080790 to Korsgaard, G.B. 2,382,809 to de Baan, WO 93/24733, WO 93/24732 to Breivik et al., US 2002/174662 to Frimm et al., U.S. Pat. No. 5,651,708 to Borseth et al., U.S. Pat. No. 5,697,732 to Sigmundstad at al., FR 2 770 484 (Doris Engineering), U.S. Pat. No. 5,305,703 to Korsgaard at al., WO 02/092423 (Ingenium AS; Fosso, Jan), U.S. Pat. No. 5,339,760 to Korsgaard et al., and U.S. Pat. No. 5,628,657 to Breivik et al.

Due to the increase in LNG demand seen in recent years, increased emphasis has been placed on cost, design and schedule efficiency of new LNG transfer projects in order to reduce the cost of the delivered gas. Improvements in cost, design, and schedule efficiency can help mitigate the substantial commercial risk associated with large LNG transfer projects.

SUMMARY

One embodiment of the invention includes a system for transporting a cryogenic fluid between a floating vessel and a second location. The system includes a first cryogenic riser having a first end and a second end, the first riser adapted to allow the vertical position of the first end of the first riser to be changed, the second end of the first riser located in a body of water and in fluid communication with the second location and at least a portion of the first riser being insulated. The system further includes a first submersible turret connector connected to the first end of the first riser. The first connector is adapted for releasably connecting to a first floating vessel located on the body of water so that a cryogenic fluid can be communicated between the first vessel and the first end of the first riser, the first connector being moored to the bottom of the body of water such that the vertical position of the first connector can be changed, and the first connector adapted to allow the first vessel to rotate around the first connector upon the surface of the body of water while the first vessel is connected to the first connector.

One embodiment of the invention includes a system for transporting a cryogenic fluid between a floating vessel and a second location. The system includes a first cryogenic riser having a first end and a second end, the first riser adapted to allow the vertical position of the first end of the first riser to be changed and the second end of the first riser located in a body of water and in fluid communication with the second location.

The system further includes a first submersible turret connector connected to the first end of the first riser, the first connector adapted for releasably connecting to a first floating vessel located on the body of water so that a cryogenic fluid can be communicated between the first vessel and the first end of the first riser, the first connector being moored to the bottom of the body of water such that the vertical position of the first connector can be changed, and the first connector adapted to allow the first vessel to rotate around the first connector upon the surface of the body of water while the first vessel is connected to the first connector. The system further includes a pipeline cryogenic fluid conduit having a first end and a second end, the first end of the pipeline conduit in fluid communication with the second end of the first riser, the second end of the pipeline conduit in fluid communication with the second location, the pipeline conduit at least partially submerged within the body of water. The system further includes at least a portion of the first riser, at least a portion of the pipeline conduit, or both being insulated.

One embodiment of the invention includes a method of transporting a cryogenic fluid between a floating vessel and a second location. The method includes communicating a cryogenic liquid through a cryogenic fluid transfer conduit between a first vessel and a second location. The cryogenic fluid conduit includes a first cryogenic riser having a first end and a second end, the first riser adapted to allow the vertical position of the first end of the first riser to be changed, the second end of the first riser located in a body of water and in fluid communication with the second location and at least a portion of the first riser being insulated. The cryogenic fluid conduit further includes a first submersible turret connector connected to the first end of the first riser, the first connector adapted for releasably connecting to the first vessel located on the body of water so that the cryogenic fluid can be communicated between the first vessel and the first end of the first riser, the first connector being moored to the bottom of the body of water such that the vertical position of the first connector can be changed, and the first connector adapted to allow the first vessel to rotate around the first connector upon the surface of the body of water while the first vessel is connected to the first connector.

One embodiment of the invention includes a method of transporting a cryogenic fluid between a floating vessel and a second location. The method includes communicating a cryogenic liquid through a cryogenic fluid transfer conduit between a first vessel and a second location. The cryogenic fluid conduit includes a first cryogenic riser having a first end and a second end, the first riser adapted to allow the vertical position of the first end of the first riser to be changed, the second end of the first riser located in a body of water and in fluid communication with the second location. The cryogenic fluid conduit further includes a first submersible turret connector connected to the first end of the first riser, the first connector adapted for releasably connecting to the first vessel located on the body of water so that the cryogenic fluid can be communicated between the first vessel and the first end of the first riser, the first connector being moored to the bottom of the body of water such that the vertical position of the first connector can be changed, and the first connector adapted to allow the first vessel to rotate around the first connector upon the surface of the body of water while the first vessel is connected to the first connector. The cryogenic fluid conduit further includes a pipeline cryogenic fluid conduit having a first end and a second end, the first end of the pipeline conduit in fluid communication with the second end of the first riser, the second end of the pipeline conduit in fluid communication with the second location and the pipeline conduit at least partially submerged within the body of water. The cryogenic fluid conduit further includes at least a portion of the first riser, at least a portion of the pipeline conduit, or both being insulated.

One embodiment of the invention includes a method of transporting a cryogenic fluid between a first location and a floating vessel located on a body of water. The method includes connecting a first floating vessel to a first submersible turret connector. The first connector adapted for releasably connecting to the first floating vessel so that a cryogenic fluid can be communicated between the first floating vessel and the first connector, the first connector being moored to the bottom of the body of water such that the vertical position of the first connector can be changed, and the first connector adapted to allow the first floating vessel to rotate around the first connector upon the surface of the body of water while the first floating vessel is connected to the first connector. The method further includes communicating a cryogenic fluid between the first floating vessel and the first connector. The method further includes communicating the cryogenic fluid between the first connector and a first cryogenic riser. The first riser having a first end and a second end, the first end of the first riser connected to the first connector, the second end of the first riser located in a body of water and in fluid communication with the second location, and the first riser adapted to allow the vertical position of the first end of the first riser to be changed. The method further includes communicating the cryogenic fluid between the first riser and a pipeline cryogenic fluid conduit, the pipeline conduit having a first end and a second end, the first end of the pipeline conduit in fluid communication with the second end of the first riser, the second end of the pipeline conduit in fluid communication with the second location, and the pipeline conduit at least partially submerged within the body of water.

DETAILED DESCRIPTION

Figure 1:
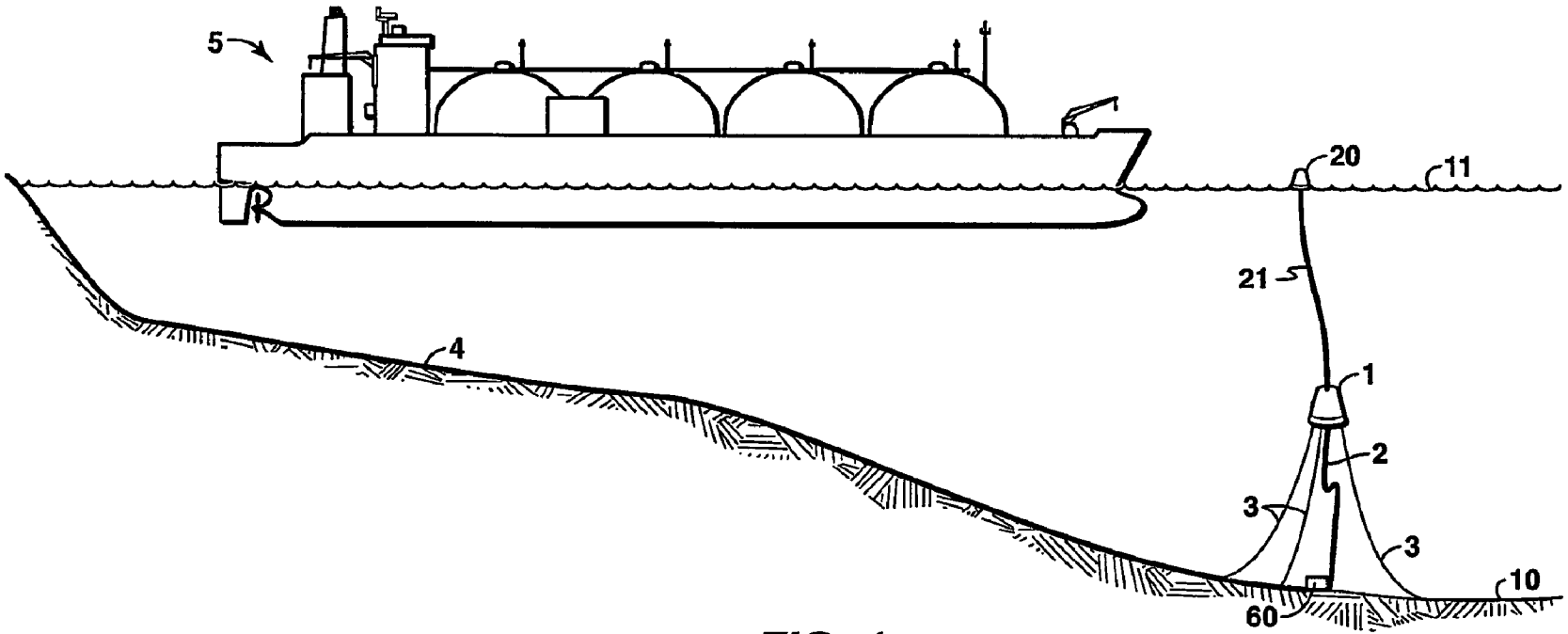
FIG. 1 depicts one embodiment of the invention including a submersible cryogenic turret connector submerged in a body of water and disconnected from a floating carrier vessel.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Several embodiments of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology. Various terms as used herein are defined below. To the extent a term used in a claim is not defined below, it should be given the broadest definition persons in the pertinent art have given that term as reflected in printed publications and issued patents.

As used herein and in the claims the term "cryogenic" means a temperature below −28.9° C. degrees Celsius (−20° F. degrees Fahrenheit). Cryogenic used in reference to a fluid means that the fluid is at a cryogenic temperature. Cryogenic used in reference to an item or material means that the item or material is suitable for operating at a cryogenic temperature and/or suitable for containing a cryogenic fluid. For example, a cryogenic riser is a riser that is suitable for containing a cryogenic fluid.

As used herein and in the claims the phrase "cryogenic fluid" means a liquid, gas, dense phase or combinations thereof which is at a cryogenic temperature. Exemplary cryogenic fluids include liquefied natural gas (LNG), pressurized liquefied natural gas (PLNG), refrigerated liquefied petroleum gas (LPG), liquid nitrogen, or any other fluid at a cryogenic temperature.

As used herein and in the claims the term "facility" means a structure that is capable of storing and/or processing a fluid. Processing a fluid includes, for example, gasifying, regasifying, vaporizing, liquefying and/or transferring the fluid.

As used herein and in the claims the term "land-based structure" means a facility that is located on land. Exemplary land-based structures include land-based regasification units, land-based storage tanks, land-based import and/or export terminals, and combinations thereof.

As used herein and in the claims the phrase "floating vessel" means a facility that floats on the surface of a body of water. The term floating used with respect to a vessel means that the vessel is buoyant within the body of water and may have a draft within the body of water such that a portion of the vessel is located below the surface of the body of water while at least a portion of the vessel is located above the surface of the body of water. A floating vessel may be moored, anchored, dynamically positioned and/or freely floating within the body of water. Exemplary floating vessels include ships, barges, Floating Storage and Regasification Units (FSRU's), Floating LNG (FLNG) vessels, floating import and/or export terminals, floating regasification platforms, floating storage platforms, and combinations thereof.

As used herein and in the claims the phrase "floating cryogenic fluid storage vessel" means a floating vessel that contains storage devices capable of containing a cryogenic fluid. Exemplary storage devices include spherical tanks, membrane tanks, plate-frame tanks, concrete tanks, composite tanks and other tanks suitable for storing cryogenic fluids. Exemplary floating cryogenic fluid storage vessels include ships, barges, Floating Storage and Regasification Units (FSRU's), Floating LNG (FLNG) vessels, floating import and/or export terminals, floating storage platforms, and combinations thereof.

As used herein and in the claims the phrase "floating storage vessel" means a floating vessel that contains storage devices capable of containing a fluid. Exemplary storage devices include spherical tanks, membrane tanks, plate-frame tanks, concrete tanks, composite tanks and other tanks suitable for storing cryogenic fluids. Exemplary floating storage vessels include ships, barges, Floating Storage and Regasification Units (FSRU's), Floating LNG (FLNG) vessels, floating import and/or export terminals, floating storage platforms, and combinations thereof.

As used herein and in the claims the phrase "floating carrier vessel" means a floating storage vessel which is capable of self-propelled or assisted travel over the surface of a body of water. The word travel is meant to refer to movement from one location to another location that are at least 1 kilometer apart. A ship is an example of a self-propelled floating carrier vessel. A barge is an example of an assisted movement floating carrier vessel. Exemplary floating carrier vessels include ships, barges, and combinations thereof.

As used herein and in the claims the phrase "bottom founded structure" means a facility that is supported by the bottom of a body of water. The weight of a bottom founded structure is at least partially supported by the bottom of the body of water. Portions of bottom founded structures may be located, for example, above the surface of a body of water, on the surface of a body of water, or combinations thereof. Exemplary bottom-founded structures include bottom-founded storage and/or regasification units, bottom founded import and/or export terminals, gravity based structures (CBS's), facilities supported by a steel pile jacket and combinations thereof.

As used herein and in the claims the phrase "fluid conduit" means a conduit capable of providing an enclosed flow path for a fluid from one location to a second location. Exemplary fluid conduits include pipes, risers, hoses and combinations thereof.

As used herein and in the claims the term "riser" means one or more fluid conduit(s) capable of communicating a fluid between a first location or locations and a second location or locations where the first and second location(s) have a different vertical height and at least one of the first or second location(s) is within a body of water. For example, the first location may be near the surface of a body of water and the second location may be greater than 30 meters under the surface of a body of water. An exemplary riser is a pipe or hose running from the bottom of a body of water to within 20 meters above or below the surface of a body of water.

As used herein and in the claims the term "flexible riser" means a riser that has the ability to change shape in order to change the vertical distance between the endpoints of the riser. For example, a riser made from a flexible hose, flexible pipe, or a riser made from rigid pipe with articulating joints such that the vertical distance between the first end of the riser can be changed relative to the second end of the riser.

As used herein and in the claims the term "manifold" means a device having one or more inlet(s) and one or more outlets where the manifold inlet(s) are capable of connecting one or more fluid conduits to one or more of the manifold outlet(s).

As used herein and in the claims the phrase "splitter manifold" means a manifold having 1) one or more inlet(s) and two or more outlets where the manifold inlet(s) are capable of connecting one or more fluid conduits to two or more of the manifold outlet(s) or 2) two or more inlet(s) and one or more outlets where the manifold inlet(s) are capable of connecting one or more fluid conduits to one or more of the manifold outlet(s).

As used herein and in the claims the phrase "messenger buoy" means a buoy that floats on and remains on the surface of a body of water. A messenger buoy is connected to a submersible device and serves as a means of locating a submersible device while the submersible device is submerged below the surface of the body of water.

As used herein and in the claims the term "insulated" means either (1) the inclusion of a separate thermal insulating material on or within an item or (2) an item constructed such that in operation it will act as a thermal insulating material. A thermal insulating material is defined as a material with a thermal conductivity of less than 12 Watts/m-° C. (7 Btu/hr-ft-° F.). Exemplary insulating materials include mineral fibers (such as perlite), rubber, plastic foams (e.g. polyurethane foams, polyvinyl chloride foams, polystyrene foams), glass fibers, a vacuum, and/or microporous insulation such as aerogel. The term item used above is meant to refer to any physical item. Exemplary items include risers, pipelines, fluid conduits. Exemplary insulated items include a pipe-in-pipe construction with any of the above mentioned insulating materials in the annulus between the pipes, a hose made in part of stainless steel wire, polymeric films and polymeric fabrics, polyurethane foam and rubber, a composite pipe made of stainless steel bellows, polypropylene armors, insulation and rubber.

One embodiment of the invention includes a subsea LNG transfer system (SLTS). The SLTS includes a disconnectable cryogenic turret, cryogenic riser system, and optionally a subsea cryogenic pipeline. This system may be used as an element in the delivery of cryogenic fluids, for example liquefied natural gas (LNG), via floating carrier vessels, for example ships. An exemplary LNG delivery chain consists of gas production from underground reservoirs, gas processing/treating to remove heavier hydrocarbons and undesirable components, such as mercury, hydrogen sulfide and carbon dioxide, a liquefaction plant to refrigerate the natural gas to a liquid state for storage and transport, an export terminal facility, for example a harbor with berths for LNG floating carrier vessels, LNG floating carrier vessels (e.g. ships) for marine transportation of the LNG from the export terminal to the market location, and an import terminal at the market location to receive the LNG from the LNG floating carrier vessel, store and vaporize the LNG into natural gas to be transmitted to the market by pipeline. Other modifications of the LNG delivery chain are also possible. For example, the floating carrier vessels used for transporting the LNG could be equipped with liquefaction or regasification facilities so that the import or export terminals or associated facilities would not be required to have such facilities. The gas production might be accomplished on land and/or offshore. In the case of offshore production a floating production vessel might be used either alone or in combination with a separate or integral floating storage vessel. For offshore production, a separate or integral liquefaction vessel could also be used. Other modifications of the LNG delivery chain are also possible.

Some embodiments of the invention are associated primarily with the import terminal component of the delivery chain, while others have application to the export terminal facility. One function of embodiments of the invention is the transfer of LNG from (or to) an LNG floating carrier vessel at a terminal location via a cryogenic disconnectable internal passive turret system through a cryogenic subsea riser to a subsea cryogenic pipeline. An internal turret system is a turret that is entirely contained or surrounded by the hull structure of the floating vessel, such that the turret itself is not exposed to wave action when connected to the floating vessel. A passive turret system is a turret system that enables the floating vessel to freely weathervane or rotate as "driven" by environmental forces about the axis of the turret without requiring assistance from the floating vessel's propulsion system or thrusters.

One aspect of some embodiments of the invention is that they enable the transfer of LNG to or from an LNG floating carrier vessel to a terminal, or even to or from one LNG floating carrier vessel to another LNG floating carrier vessel, via a cryogenic subsea (riser and pipeline) system. To enable the LNG floating carrier vessel to perform the LNG transfer with high operability and reliability, a disconnectable cryogenic turret/mooring system is also incorporated into the concept. This allows the LNG floating carrier vessel to connect in relatively high seas, to weathervane in response to wind, waves and current, and to remain connected through severe conditions while transfering LNG.

When an LNG floating carrier vessel is not attached to the disconnectable turret/mooring/riser system, the turret is typically suspended below the sea surface, for example this could be in the middle of the water column or on the seafloor. In this way, the disconnected cryogenic turret is protected from accidental collision with other vessels. A surface messenger buoy with a pull-in line may be connected to the turret. As the LNG floating carrier vessel arrives on site, it maneuvers over the turret location, picks up the messenger buoy, transfers the messenger line with the turret pull-in line attached through the turret compartment in the LNG floating carrier vessel, and, with a winch or other system, pulls the turret up into its turret compartment recess. When completely pulled in, the turret is locked in place, and the LNG transfer connection is made from the ship LNG piping system to the turret LNG piping. Swivels inside the ship or inside the turret enable the LNG floating carrier vessel to transfer the LNG to or from the cryogenic riser system while the ship is weathervaning about the geostationary turret/mooring/riser system. While connected, the LNG floating carrier vessel stationkeeping is maintained by the turret/mooring system, consisting of the turret and connected wire/chain mooring lines with anchors in the seabed. Alternatively, when moored, vessel stationkeeping may be assisted with the use of the vessels' thrusters and propulsion, including, for example, dynamic positioning systems. When the LNG offloading (or loading) has been completed, the turret is disconnected from the LNG floating carrier vessel and allowed to sink in the water column. The LNG floating carrier vessel then departs to return to the export port to pick up another cargo of LNG or alternatively to the import port to discharge cargo taken on at the export port.

Two companies, Advanced Production Loading (APL) and SOFEC, affiliated with FMC, have built disconnectable turrets for hydrocarbon production offloading. APL's system is known as a submerged turret loading (STL) system and was first used by Shell/Esso in the early 1990s to anchor the MV VINGA, which served as a replacement to the Fulmar Floating Storage Unit (FSU) in the North Sea. APL also makes a version of the STL with the capability to accommodate multiple fluid paths for full-wellstream production, water injection, gas lift, subsea controls and gas export. This system is known as a submerged turret production (STP) system. SOFEC's disconnectable turret is also a multiple fluid path production system and is used at the TERRA NOVA FPSO on the Grand Banks. However, for cryogenic service, the above-described STP and STL systems would likely be modified. The changes include: 1) cryogenic fluid paths within the turret buoy, 2) connections to cryogenic risers at the bottom of the turret buoy, 3) cryogenic connectors at the top of the turret buoy, 4) a cryogenic swivel system inside the turret compartment in the vessel or ship and 5) a recirculation path or "U" inside the turret buoy to enable the entire cryogenic line to remain cold when disconnected, or combinations thereof. Additional turret buoys for cryogenic applications are described in U.S. Pat. No. 5,983,931 to Ingebrightsen et al., which is hereby incorporated by reference.

The SLTS system described herein could also be used to transfer cold or cryogenic fluids other than LNG, such as Pressurized LNG (PLNG) or refrigerated liquefied petroleum gas (LPG).

In some locations, the export or import terminal may be located in a harsh environment region, where higher seas and stronger winds are prevalent. In other cases, the terminal may be located in an environment where sea ice and/or icebergs can occur. Furthermore, the invention has application for floating terminals, either import Floating Storage and Regasification Units (FSRUs) or Floating LNG (FLNG) export units. The current LNG transfer technology described in the Background section, has limited operability in harsh environment settings. SLTS is an offshore LNG transfer system that enables exceptional offloading operability in severe-environment or Arctic locations. Additionally, the system is adaptable to virtually any geographic region. SLTS also provides the flexibility to be implemented as a primary transfer system or as an expansion of existing LNG terminal capabilities.

Embodiments of the invention include a system and method for the transfer of LNG from (or to) an LNG floating carrier vessel at a terminal location via a cryogenic disconnectable internal passive turret system through a cryogenic subsea riser to a subsea cryogenic pipeline. As stated earlier, one aspect of embodiments of the invention is that it enables the transfer of LNG to or from an LNG floating carrier vessel to a terminal (or even to or from one LNG floating carrier vessel to another LNG floating carrier vessel) solely via a cryogenic subsea (riser and pipeline) system.

One embodiment of the SLTS may include a disconnectable cryogenic turret, with mooring lines and anchors. The SLTS may further include a cryogenic riser system and optionally a cryogenic pipeline system.

Further embodiments of the invention may include a continuous round-trip flow loop to enable the circulation of LNG from the terminal (import or export), through the terminal-side riser system (as applicable), through the subsea cryogenic pipeline, through the turret riser system to the cryogenic disconnectable turret, and through the turret to return through the riser to the pipeline and back to the terminal. The purpose of this round-trip flow loop is to circulate LNG in the SLTS to maintain the system at cryogenic temperatures when the turret is disconnected from the LNG floating carrier vessel (i.e., between loadings or offloadings). In a likely embodiment, this entails duplicate risers and parallel, but opposite-flowing (during recirculation) subsea pipelines (or mid-depth flowlines). Alternatively, the pipeline fluid conduits and/or riser fluid conduits could be of the "pipe-in-pipe" type as described in U.S. Pat. No. 6,012,292 to Gulati et al., the entirety of which is hereby incorporated by reference herein. The turret configuration would enable the circulation of the LNG in this round-trip flow loop.

Embodiments of the invention may include one or more pipeline end manifolds (PLEMs) at each end of the subsea cryogenic pipeline. The PLEM serves as a connection point for the cryogenic riser system. A surface-controlled subsea safety valve may be located in the PLEM that is capable of shutting off LNG flow through both the primary and circulation flowpaths in the event of an emergency at the terminal, emergency on the LNG floating carrier vessel, damage to or failure of the turret and riser system, or damage to the pipeline.

Embodiments of the invention may include a control system (hydraulic, electrohydraulic, or other) to control the safety valves in the PLEM/s. This will entail subsea control umbilicals running from the turrets to the PLEM/s from the terminal and/or LNG floating carrier vessel as appropriate. Control systems may be located at the terminal and possibly on the LNG floating carrier vessels.

Embodiments of the invention may include a disconnectable cryogenic turret housing and LNG piping, valves, fittings, pumps and control systems and vessel propulsion and maneuvering systems required to control the position of the LNG floating carrier vessels during buoy pickup on the LNG floating carrier vessels, as applicable. In the case of an import terminal application of SLTS, LNG pumps on the LNG floating carrier vessels (in addition to the pumps already located in the LNG floating carrier vessel tanks) will likely be required to overcome the pressure drop through the SLTS turret-riser-pipeline-riser system to the import terminal (FSRU, GBS or onshore). Embodiments of the invention are described below with reference to the accompanying figures.

FIG. 1 depicts an SLTS system that includes a submersible cryogenic turret connector (1) attached to and in fluid communication with one end of a cryogenic riser (2) with the second end of the cryogenic riser (2) attached to and in fluid communication with one end of a subsea pipeline (4). FIG. 1 also depicts a floating carrier vessel (5), for example an LNG floating carrier vessel approaching the submersible cryogenic turret connector (1). The submersible cryogenic turret connector (1) is moored to the floor (10) of the body of water by mooring lines (3) in a way that allows the vertical position of the submersible cryogenic turret connector (1) to be changed. For example, the submersible cryogenic turret connector (1) might be moored 30 meters below the surface (11) of the body of water when not connected to a floating carrier vessel (5) and raised to a level within 10 or 20 meters of the surface (11), either above or below, of the body of water for connection to the floating carrier vessel (5). Alternatively the submersible cryogenic turret connector (1) could be moored 20, 40, or 50 meters or more below the surface (11) of the body of water when not connected to a floating carrier vessel (5). Alternatively, the submersible cryogenic turret connector (1) could be allowed to fall to the floor (10) of the body of water when not connected.

As previously discussed, a messenger buoy (20) may be connected to the submersible cryogenic turret connector (1) by line (21). The messenger buoy (20) serves as a means of locating the submersible cryogenic turret connector (1) and the line (21) serves as a means of hoisting the submersible cryogenic turret connector (1) to a vertical position near the surface (11) of the body of water so that the submersible cryogenic turret connector (1) can be connected to the floating carrier vessel (5). The line (21) could be a metal chain, nylon rope, or other means of connecting the messenger buoy (20) to the submersible cryogenic turret connector (1).

The second end of the cryogenic riser (2) is attached to subsea pipeline (4) that is located completely below the surface (11) of the body of water and travels to a second location, for example to shore (not shown). Here the pipeline (4) is located on the surface of the floor (10) of the body of water. Here the cryogenic riser (2) is attached to subsea pipeline (4) by means of a subsea manifold (60). As previously discussed the subsea manifold (60) may include shut off valves which can be used to isolate the riser (2) from the pipeline (4). The cryogenic riser may alternatively include a first riser fluid conduit and a second riser fluid conduit. The first end of the first riser conduit and a first end of the second riser conduit may be attached to the submersible cryogenic turret connector. The second end of the first riser conduit and the second end of the second riser conduit may be in fluid communication with the pipeline. Alternatively, the second end of the first riser conduit and the second end of the second riser conduit may be connected to the manifold. Alternatively, the cryogenic riser may include a plurality of riser fluid conduits. Alternatively, the first and second riser conduits may be moored to separate locations on the floor of the body of water. Alternatively, the first and second riser conduits may be moored to the same location on the floor of the body of water. Where a plurality of riser conduits are included each of the respective riser conduits may be moored to the same or separate locations on the floor of the body of water.

The second location may include a facility that is located on land or land-based. Exemplary land-based facilities include land-based regasification units, land-based storage vessels, land-based import and/or export terminals, and combinations thereof. Alternatively, the second location may include a facility located above the surface of a body of water, on the surface of a body of water, or combinations thereof. The facility may be capable of storing and/or processing a fluid, for example a cryogenic fluid. Exemplary facilities include, for example, bottom-founded structures and floating vessels. Exemplary facilities include ships, barges, Floating Storage and Regasification Units (FSRU's), bottom-founded storage and/or regasification units, floating import and/or export terminals, bottom founded import and/or export terminals, floating regasification platforms, floating storage platforms, gravity based structures (GBS's), steel piled jacket structures and combinations thereof.

Alternatively, the pipeline (4) may be only partially located below the surface (11) of the body of water. Alternatively, the pipeline (4) may be completely or partially suspended within the body of water. Alternatively, the pipeline (4) may be completely or partially buried below the floor (10) of the body of water.

The cryogenic riser (2) depicted in FIG. 1 is capable of communicating a fluid between the floor (10) of the body of water and the submersible cryogenic turret connector (1). For example, one end of the cryogenic riser (2) may be near the surface of a body of water and connected to and in fluid communication with the submersible cryogenic turret connector (1) and the second end may be connected to and in fluid communication with the pipeline (4) located on the floor (10) of the body of water. In one embodiment, the cryogenic riser (2) is a flexible riser that has the ability to change the vertical distance between the endpoints of the riser. For example, the cryogenic riser (2) may be made from a flexible cryogenic hose, flexible pipe or the riser may be made from rigid pipe with articulating joints such that the vertical distance between the first end of the riser can be changed relative to the second end of the riser.

A cryogenic riser could be constructed from subsea flexible pipe similar to those manufactured by Technip Coflexip or Wellstream for oil and gas riser service with a modified fluid liner suitable for cryogenic temperatures and an insulation system appropriate to prevent ice formation on the outside surface of the riser. Exemplary fluid liner materials include, for example, stainless steel, 9% nickel steel, 36% nickel steel referred to as INVAR. Exemplary insulation materials include, for example, polyurethane foams, a vacuum, and/or microporous insulation such as aerogel.

Alternatively, a cryogenic riser could be constructed from a cryogenic cargo hose similar to those manufactured by Senior Flexonics or Dante that is structurally reinforced to resist hydrostatic forces and to provide appropriate bending stiffness, insulated to prevent ice formation and equipped with a water proof exterior. Exemplary insulation materials include, for example, polyurethane foams, a vacuum, and/or microporous insulation such as aerogel.

A third cryogenic riser construction could include an insulated pipe-in-pipe construction similar to that manufactured by Nexans with insulation in the annulus between the flexible pipes. Exemplary insulation materials include, for example, polyurethane foams, a vacuum, and/or microporous insulation such as aerogel.

A fourth cryogenic riser construction could include an arrangement of hard pipe sections insulated with water-proof insulation and inline cryogenic swivels like those utilized in LNG loading arms manufactured by FMC, SVT or Woodfield modified for underwater service. The hard pipe sections could be made from suitable cryogenic materials that have adequate low temperature toughness for the temperatures experienced in the specific cryogenic applications. Exemplary, cryogenic materials include, for example, high nickel steels, austenitic steels, and/or aluminum. Exemplary high nickel steels include steels having greater than 6% nickel, alternatively greater than 7% or 9% nickel. Welds used with the above-described metals should similarly have sufficient low temperature toughness for the temperatures experienced in the specific cryogenic applications. Exemplary welding techniques include plasma arc welding (PAW), metal inert gas (MIG) welding and gas tungsten arc welding (GTAW). Exemplary insulation materials include, for example, polyurethane foams, a vacuum, and/or microporous insulation such as aerogel.

FIG. 1 depicts a floating carrier vessel (5), for example an LNG floating carrier vessel approaching the submersible cryogenic turret connector (1). Exemplary floating carrier vessels include ships, barges, and combinations thereof. Alternatively the vessel may be a floating cryogenic fluid storage vessel that contains storage devices capable of containing a cryogenic fluid. Exemplary storage devices include spherical tanks, membrane tanks, plate-frame tanks, concrete tanks, composite tanks and other tanks suitable for storing cryogenic fluids. Exemplary floating cryogenic fluid storage vessels include ships, barges, Floating Storage and Regasification Units (FSRU's), floating import and/or export terminals, floating storage platforms, and combinations thereof. The following figures depict some of the above-referenced alternatives to the embodiment disclosed in FIG. 1.

Figure 2:
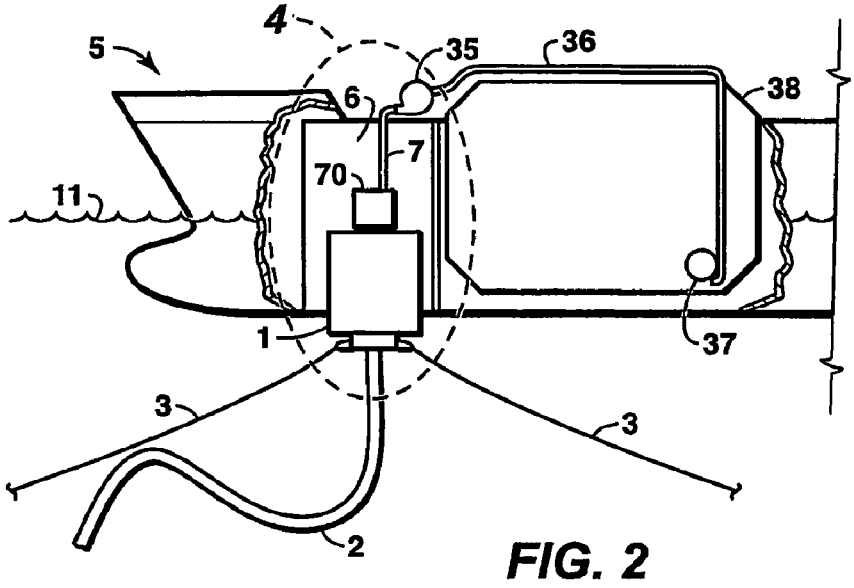
FIG. 2 depicts one embodiment of a submersible cryogenic turret connector connected to a vessel within a vessel receptacle.

FIG. 2 depicts a cut away view of a floating carrier vessel (5) to which a submersible cryogenic turret connector (1) has been connected within a receptacle (6) located within the floating carrier vessel (5). The lower portion of the submersible cryogenic turret connector (1) is attached to and in fluid communication with one end of a cryogenic riser (2). The submersible cryogenic turret connector (1) is moored to the floor (not shown) of the body of water by mooring lines (3) in a way that allows the vertical position of the submersible cryogenic turret connector (1) to be changed. For example, the submersible cryogenic turret connector (1) may be connected to a messenger buoy by a line (not shown). The messenger buoy can be picked up by the floating vessel thereby enabling the connecting line to the submersible cryogenic turret connector to be transferred into the receptacle (6) located within the floating carrier vessel and connected to (5) a winch located on the floating carrier vessel (5). Thus the submersible cryogenic turret connector (1) is lifted from a first position at a depth somewhere in the middle of the body of water to a second location near the surface (11) of the body of water and within the receptacle (6) located within the floating carrier vessel (5).

For shallow water (and even for deep water) the scope of the mooring system (distance from turret to anchors) is usually large. Thus, the sine of the turret mooring profile angle is small. This means that it does not take a lot of vertical force to lift a disconnectable buoy, such as a submersible cryogenic turret connector (1), upward in the body of water. The submersible cryogenic turret connector (1) may be lifted with a winch with 100 mt capacity or slightly more, however, such a force would be insufficient to pull the anchor mechanism (e.g. pile anchors) out of the seabed horizontally.

Vessel cryogenic fluid transfer line (7) connects to the upper portion of the submersible cryogenic turret connector (1) at a swivel (not shown), which is then connected to a mating element (not shown), thereby providing fluid communication between the submersible cryogenic turret connector (1) and the vessel (5). The swivel, mating element and associated equipment are depicted generally as manifold/swivel stack (70) in FIG. 2. The cryogenic fluid may be pumped to or from a cryogenic fluid storage tank (38) by vessel storage tank pump (37) and vessel booster pump (35). Alternatively, the function of the vessel booster pump (35) and vessel storage tank pump (37) could be combined in one pump, preferably located within the fluid storage tank (38). Cryogenic fluids may be communicated between the cryogenic fluid storage tank (38) and submersible cryogenic turret connector (1) through vessel feed storage line (36).

When an LNG floating carrier vessel arrives at the SLTS site, it picks up a messenger buoy and connection line, which then enables the line used to lift the submersible cryogenic turret connector to be attached to the winch above the turret compartment. Thus, the submersible cryogenic turret connector can be winched up into the receptacle in the turret compartment of the LNG floating carrier vessel.

Figure 3:
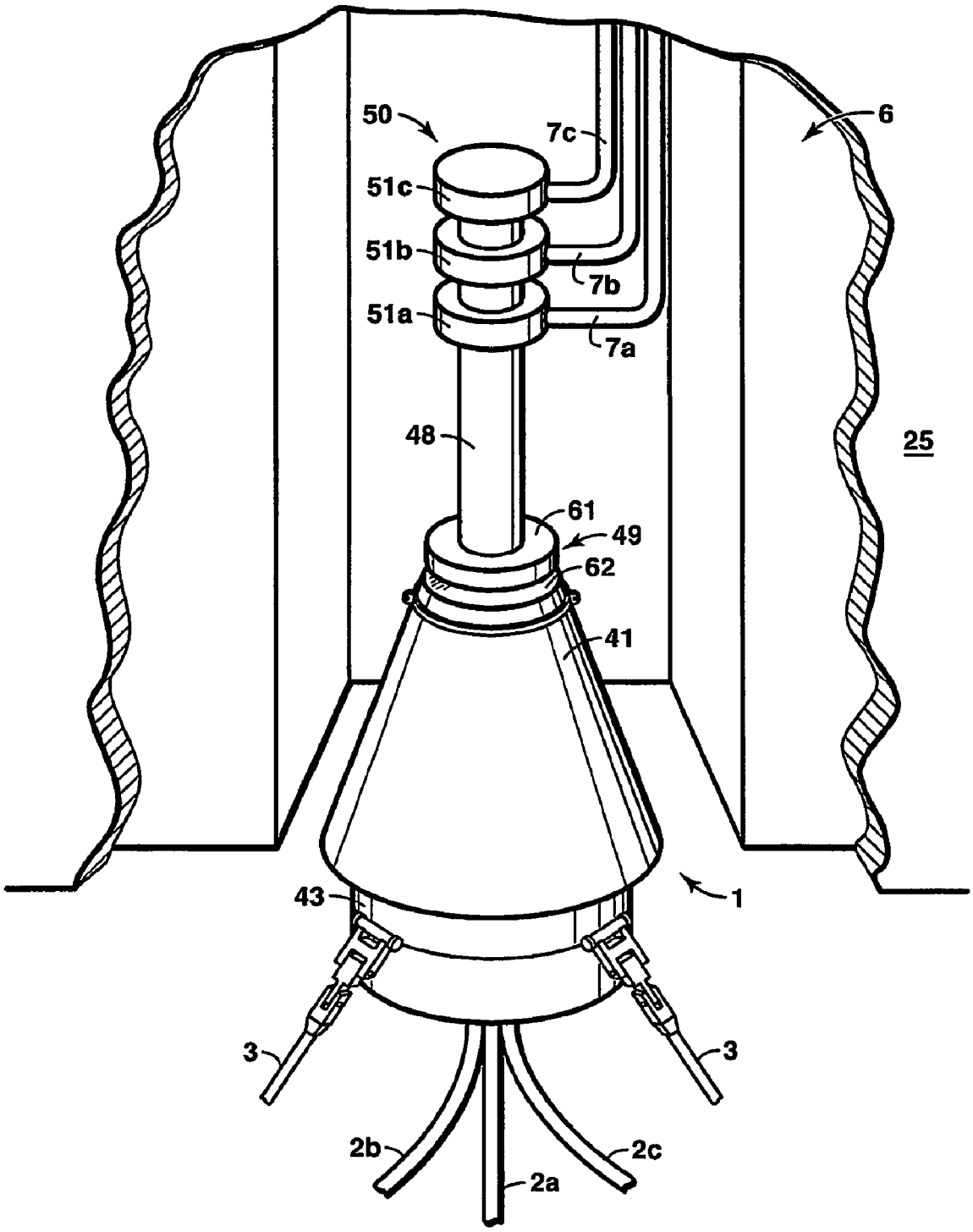
FIG. 3 depicts an alternative embodiment of a submersible cryogenic turret connector connected to a vessel within a vessel receptacle.

FIG. 3 depicts an alternative submersible cryogenic turret connector (1) that has been connected to a receptacle (6) located within a floating vessel (25). FIG. 3 shows the upper portions of three cryogenic risers (2*a*, 2*b*, 2*c*) attached to the submersible cryogenic turret connector (1). Vessel mating connector (49) connects to a mating element (62) on the upper portion (41) of the submersible cryogenic turret connector (1) thereby providing fluid communication from the submersible cryogenic turret connector (1) to the manifold (48) of the floating vessel piping system. The manifold (48) contains three internal fluid conduits (not shown) which are in fluid communication with vessel fluid transfer lines (7*a*, 7*b*, 7*c*). The three internal fluid conduits (not shown) are rotatably connected to vessel fluid transfer lines (7*a*, 7*b*, 7*c*) by three swivels (51*a*, 51*b*, 51*c*) located in swivel stack (50). The system depicted in FIG. 3 provides three separate fluid flow paths from three separate risers (2*a*, 2*b*, 2*c*), through the submersible cryogenic turret connector (1) to three separate vessel fluid transfer lines (7*a*, 7*b*, 7*c*).

The upper portions of the mooring lines (3) are depicted attached to the lower portion (43) of the submersible cryogenic turret connector (1). The upper portion (41) of the submersible cryogenic turret connector (1) is rotatably connected to the lower portion (43) of the submersible cryogenic turret connector (1) with one or more structural bearings. In FIG. 3 the vessel has multiple vessel fluid transfer lines (7*a*, 7*b*, 7*c*) which could be used for multiple vessel import lines, multiple vessel export lines, or combinations thereof.

Figure 4:
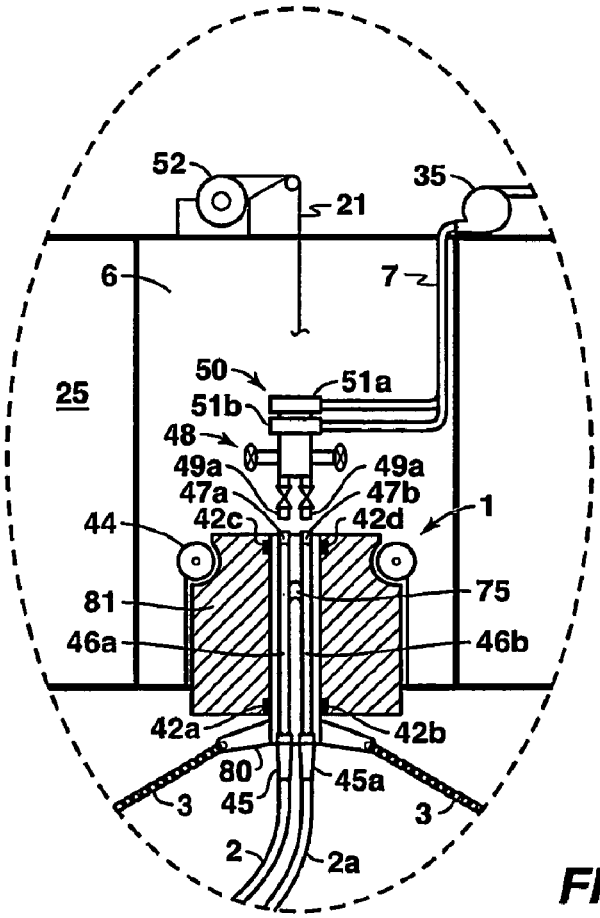
FIG. 4 depicts a cut away view of one embodiment of a submersible cryogenic turret connector located within a vessel receptacle.

FIG. 4 depicts a cut away view of an exemplary submersible cryogenic turret connector (1) which has been connected within a receptacle (6) of a floating vessel (25). FIG. 4 shows two cryogenic risers (2) and (2*a*) connected to the mooring spider (80) of the submersible cryogenic turret connector (1). Mooring lines (3) are also shown connected to the lower portion (41) of the exemplary submersible cryogenic turret connector (1). Lower radial bearing, with cut away cross section portions (42*a*, 42*b*) depicted and upper radial bearing with cut away cross section portions depicted (42*c*, 42*d*) provide a rotatable structural connection between the inner or stationary portion (containing the fluid conduits 46*a* and 46*b* and also the mooring spider 41) and the outer portion (81) of the submersible cryogenic turret connector (1), thereby permitting the outer portion to rotate relative to the inner, stationary portion. This upper and lower bearing arrangement is exemplary and other bearing configurations are possible. The outer portion (81) is connected to the vessel (25) by a releasable turret locking mechanism (44) which keeps the outer portion (81) connected to the floating vessel (25) when engaged. Thus when the turret locking mechanism (44) is engaged the floating vessel (25) and outer portion (81) can rotate with the vessel (25) while the inner portion, mooring spider (80) and mooring lines (3) remain relatively stationary.

The risers (2, 2*a*) include riser bend stiffeners (45, 45*a*) at their respective upper ends. The risers are connected to respective lower ends of the turret internal cryogenic piping (46*a*, 46*b*) which communicate cryogenic fluids through the submersible cryogenic turret connector (1). A U-bend (75) or jumper conduit is included in the embodiment in FIG. 4. The U-bend (75) may be used for recirculating cryogenic fluids in the turret internal cryogenic piping (46*a*, 46*b*), risers (2, 2*a*), and/or subsea pipeline when the system is not actively loading or unloading cryogenic fluids, thereby providing a circulation loop. The turret internal cryogenic piping (46*a*, 46*b*) should be made of suitable cryogenic materials that have adequate low temperature toughness for the temperatures experienced in the specific cryogenic applications. Exemplary cryogenic materials include, for example, high nickel steels, austenitic steels, and/or aluminum. Exemplary high nickel steels include steels having greater than 6% nickel, alternatively greater than 7% or 9% nickel. Welds used with the above-described metals should similarly have sufficient low temperature toughness for the temperatures experienced in the specific cryogenic applications. Exemplary welding techniques include plasma arc welding (PAW), metal inert gas (MIG) welding and gas tungsten arc welding (GTAW) The turret internal cryogenic piping (46*a*, 46*b*) should also be insulated. Exemplary insulation materials include, for example, polyurethane foams, a vacuum, and/or microporous insulation such as aerogel.

The upper ends of the turret internal cryogenic piping (46*a*, 46*b*) may be fitted with suitable cryogenic connectors (47*a*, 47*b*). The cryogenic connectors (47*a*, 47*b*) are alternatively quick connect/disconnect connectors. The cryogenic connectors (47*a*, 47*b*) connect to the vessel piping through a vessel manifold (48). The vessel manifold (48) may include suitable vessel cryogenic connectors (49*a*, 49*b*) which mate with the cryogenic connectors (47*a*, 47*b*) located on the upper end of turret internal cryogenic piping (46*a*, 46*b*). The vessel manifold (48) includes a swivel stack (50) which includes two cryogenic swivels (51*a*, 51*b*), one for each cryogenic flow path. Alternatively, the swivel stack may contain a different number of swivels and a different number of flow paths. Preferably, each flow path has a dedicated swivel. In operation, the cryogenic swivels (51*a*, 51*b*), lower bearing (42*a*, 42*b*) and upper bearing (42*c*, 42*d*) provide a system which allows the turret internal cryogenic piping (46*a*, 46*b*) and risers (2, 2*a*) to remain stationary while the outer portion (81) of the submersible cryogenic turret connector (1) and the vessel (25) are free to rotate on the surface of the body of water. As previously discussed with regard to the turret internal cryogenic piping (46*a*, 46*b*) the vessel cryogenic connectors (49*a*, 49*b*), cryogenic swivels (51*a*, 51*b*) and vessel cryogenic fluid transfer line (7) should also be made of suitable cryogenic materials that have adequate low temperature toughness for the temperatures experienced in the specific cryogenic applications. Exemplary materials having been previously discussed.

FIG. 4 also depicts a winch (52) attached to a line (21) that is further attached (not shown) to the submersible cryogenic turret connector (1). In this case the winch (52) was used to pull the submersible cryogenic turret connector (1) from a location within the body of water into the receptacle (6) of the vessel (25).

The systems of FIGS. 2 and 4 will now be described with reference to an LNG floating carrier vessel that is unloading LNG. The vessel booster pump (35), shown on the deck of the vessel (5), may be used to provide the pressure to convey a cryogenic fluid, for example LNG, through the SLTS system to an FSRU or other receiving facility. From the LNG booster pump (35), LNG piping (7) interior to the turret compartment receptacle (6) on the LNG floating carrier vessel (5) conveys the LNG to the swivel stack (50), enabling the LNG to be transferred from the rotating LNG floating carrier vessel piping (7) (which rotates with the LNG floating vessel carrier vessel (5)) to the essentially stationary submersible turret connector interior piping system (46*a*, 46*b*). Beneath the swivel stack (50), the LNG flows through a manifold (48) and quick connection/disconnection valve system (49*a*, 49*b*). Alternatively, it may be preferable to have the manifold (48) upstream of the swivel stack (50). Below this point, there is a physical disconnection point between the vessel-side piping and submersible cryogenic turret connector piping systems. A sliding or hinged hatch (not shown) may be used in the LNG floating carrier vessel (5) to prevent flooding of the entire turret compartment receptacle (6) when the submersible cryogenic turret connector (1) is disconnected. When connected to the LNG floating carrier vessel (5), the submersible cryogenic turret connector (1) will be held fast in place by a locking mechanism (44), typically with a mechanically positive lock that requires powered intervention to be released. Inside the submersible cryogenic turret connector (1), the LNG flow lines (46*a*, 46*b*) can be seen within the stationary inner portion (80) of the turret interior. Bearings (42*a*, 42*b*, 42*c*, 42*d*) allow the outer portion (81) of submersible cryogenic turret connector (1) to rotate with the LNG floating carrier vessel (5) around this stationary interior portion or "tube". The LNG flow lines (46*a*, 46*b*) that pass through the stationary tube are connected to the top of the flexible cryogenic risers (2, 2*a*), shown with riser bend stiffeners (45, 45*a*). Note that the risers (2, 2*a*) are also stationary. Also stationary and connected to the stationary interior "tube" is the mooring "spider" (41), to which the mooring lines (3) are attached.

Figure 5:
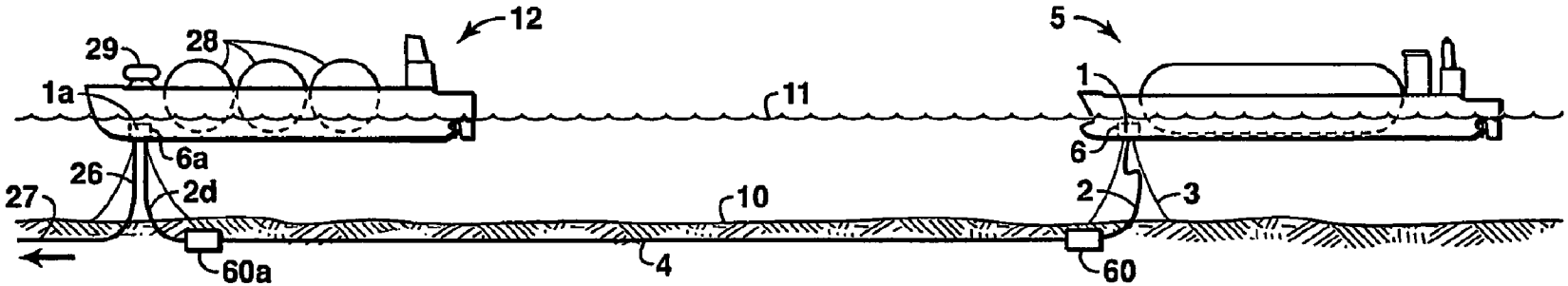
FIG. 5 depicts one embodiment of the invention including a submersible cryogenic turret connector-riser-pipeline system used to provide fluid communication between a floating carrier vessel and a Floating Storage and Regasification Unit (FSRU).

FIG. 5 depicts an embodiment of the invention that functions as an import terminal. This embodiment includes importing a cryogenic fluid from a floating carrier vessel (5) using an SLTS system and a floating storage and regasification unit (FSRU) (12). As in FIG. 1 this embodiment depicts an SLTS system that includes a submersible cryogenic turret connector (1) attached to and in fluid communication with one end of a cryogenic riser (2). The submersible cryogenic turret connector (1) is moored to the floor (10) of the body of water by mooring lines (3) in a way that allows the vertical position of the submersible cryogenic turret connector (1) to be changed. The second end of the cryogenic riser (2) is attached, at manifold (60), to subsea pipeline (4) that is located completely below the surface (11) of the body of water, in this case buried beneath the floor (10) of the body of water.

In this embodiment, the SLTS connects an FSRU (12) to a disconnectable turret mooring system several kilometers away where LNG floating carrier vessels (5) are offloaded. In alternative embodiments, the distance between the FSRU (12) and the submersible cryogenic turret connector (1) is greater than 1, 2, 3, 4 or 5 kilometers. The cryogenic turret (1*a*) in the FSRU (12) is connected at second manifold (60*a*) to the subsea pipeline (4) by second cryogenic riser (2*d*). The cryogenic turret (1*a*) in the FSRU (12) contains LNG flowpaths from the SLTS and a gas export flowpath including a gas export riser (26) that is connected to and in fluid communication with a gas export pipeline (27) to shore (not shown). The FSRU (12) includes storage tanks (28) for storing LNG and/or natural gas and LNG vaporization process equipment (29) for regasifying LNG to natural gas. The cryogenic turret (1*a*) in the FSRU (12) is connected to the FSRU (12) through a receptical (6*a*) opening located in the bottom of the hull of the FSRU (12). The FSRU (12) could be either permanently turret-moored or the turret (1*a*) could be disconnectable. Preferably the turret (1*a*) connection is capable of allowing the FSRU (12) to weathervane around the turret (1*a*) connection. Alternatively, the FSRU (12) could be moored to the floor (10) of the body of water by an external turret-mooring system, in which the turret is external to the FSRU hull and typically located above the surface (11) of the body of water. Alternatively, in shallow water, the FSRU (12) could be moored to the floor (10) of the body of water via a jacket-yoke mooring system, in which the FSRU is connected to a steel-piled jacket platform via a swivel to which is attached a counter-weighted structural yoke that attaches to the FSRU hull. Alternatively, the FSRU (12) could be moored to the floor (10) of the body of water by a spread mooring system (in which case there is no turret system) or by an open-sea berth (i.e., by dolphins and fenders).

Figure 6:
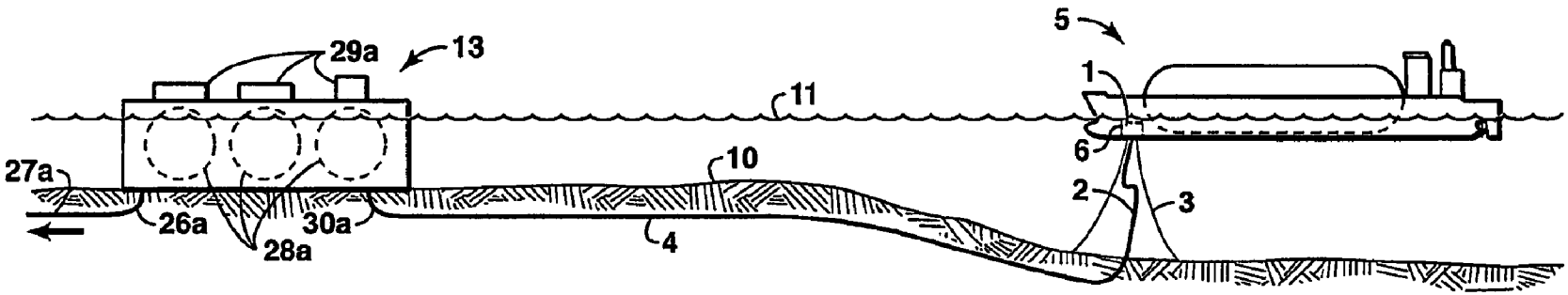
FIG. 6 depicts one embodiment of the invention including a submersible cryogenic turret connector-riser-pipeline system used to provide fluid communication between a floating carrier vessel and a bottom-founded vessel.

FIG. 6 depicts an alternative embodiment of the invention that functions as an import terminal. This embodiment includes importing a cryogenic fluid from a floating carrier vessel (5) using an SLTS system and a bottom-founded structure (13). As in FIGS. 1 and 5, this embodiment depicts an SLTS system that includes a submersible cryogenic turret connector (1) attached to and in fluid communication with one end of a cryogenic riser (2). The submersible cryogenic turret connector (1) is moored to the floor (10) of the body of water by mooring lines (3) in a way that allows the vertical position of the submersible cryogenic turret connector (1) to be changed. The second end of the cryogenic riser (2) is attached to subsea pipeline (4) that is located completely below the surface (11) of the body of water on the floor (10) of the body of water.

In this embodiment, the SLTS runs from a bottom-founded structure (13), for example a concrete or steel gravity-based structure (GBS) import terminal, to a disconnectable turret mooring system several kilometers away where LNG floating carrier vessels (5) are offloaded. The bottom-founded structure (13) is connected to the subsea pipeline (4) by second cryogenic riser (30*a*). Second cryogenic riser (30*a*) is connected to the bottom-founded structure (13) by any suitable means known in the art, for example by a rigid riser system. The bottom-founded structure (13) contains an LNG flowpath from the SLTS and a gas export flowpath including a gas export riser (26*a*) that is connected to and in fluid communication with a gas export pipeline (27*a*) to shore (not shown). Gas export riser (26*a*) is connected to the bottom-founded vessel structure (13) by any suitable means known in the art, for example by a rigid riser system. The bottom-founded structure (13) includes storage tanks (28*a*) for storing LNG and/or natural gas and LNG vaporization process equipment (29*a*) for regasifying LNG to natural gas.

Figure 7:
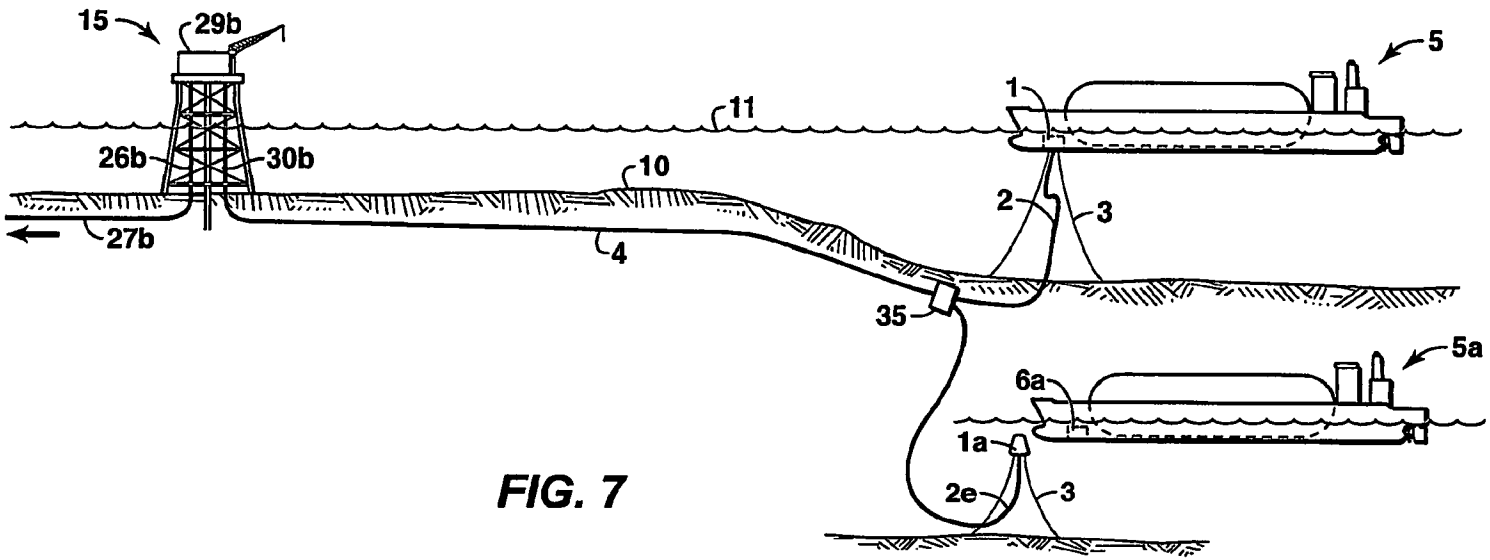
FIG. 7 depicts one embodiment of the invention including a dual submersible cryogenic turret connector-riser-pipeline system used to provide fluid communication between a floating carrier vessel and a regas platform steel-piled jacket.

FIG. 7 depicts an alternative embodiment of the invention that functions as an import terminal. In this embodiment the import terminal utilizes direct offloading of the cryogenic fluid. This embodiment depicts an SLTS system that includes two submersible cryogenic turret connectors (1) and (1*a*), each attached to and in fluid communication with one end of a respective cryogenic riser (2) and (2*e*). The submersible cryogenic turret connectors (1) and (1*a*) are moored to the floor (10) of the body of water by mooring lines (3) in a way that allows the vertical position of the respective submersible cryogenic turret connectors (1) and (1*a*) to be changed. The second end of the respective cryogenic risers (2) and (2*e*) are both attached to subsea pipeline (4) at splitter manifold (35) that is located completely below the surface (11) of the body of water on the floor (10) of the body of water. In this manner, one LNG floating carrier vessel (5) is offloading at all times through the SLTS, and no terminal storage is required. When the first LNG floating carrier vessel (5) is finished offloading at the first submersible cryogenic turret connector (1), the second LNG floating carrier vessel (5*a*) has connected to the second submersible cryogenic turret connector (1*a*) and is ready to begin offloading. A regas platform steel-piled jacket (15) is shown; however, the regas facilities could alternatively be located on land or offshore on a GBS or floating vessel.

In this embodiment, the SLTS runs from a regas platform steel-piled jacket (15) import terminal, to a disconnectable turret mooring system several kilometers away where LNG floating carrier vessels (5) are offloaded. The regas platform steel-piled jacket (15) is connected to the subsea pipeline (4) by second cryogenic riser (30*b*). Second cryogenic riser (30*b*) is connected to the regas platform steel-piled jacket (15) by any suitable means known in the art. The regas platform steel-piled jacket (15) contains an LNG flowpath from the SLTS and a gas export flowpath including a gas export riser (26*b*) that is connect to and in fluid communication with a gas export pipeline (27*b*) to shore (not shown). Gas export riser (26*b*) is connected to the regas platform steel-piled jacket (15) by any suitable means known in the art, for example by a rigid riser system. The regas platform steel-piled jacket (15) includes LNG vaporization process equipment (29*b*) for regasifying LNG to natural gas.

Figure 8:
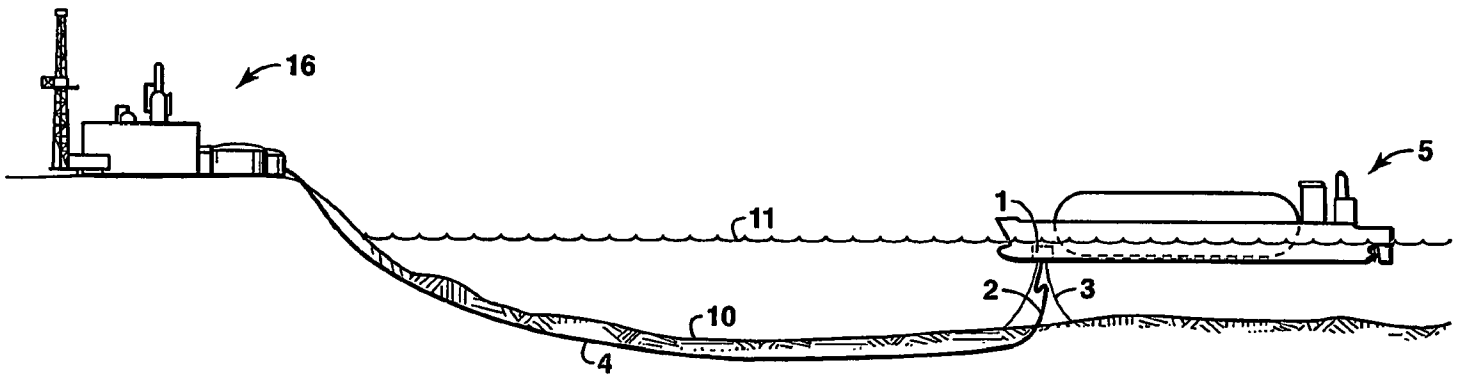
FIG. 8 depicts one embodiment of the invention including a submersible cryogenic turret connector-riser-pipeline system used to provide fluid communication between a floating carrier vessel and an onshore export terminal.

FIG. 8 depicts an embodiment of the invention that functions as an export terminal. This embodiment may include an onshore export terminal (16) that includes an LNG liquefaction plant and storage terminal. In this embodiment the SLTS runs from the onshore export terminal (16) to a submersible cryogenic turret connector (1) or connectors (not shown) offshore several kilometers away where LNG floating carrier vessels (5) are loaded.

Alternative embodiments for an onshore import terminal are also possible. Such embodiments are similar to that in FIG. 8 (Onshore Export Terminal Embodiment), except that the onshore terminal is an import terminal with LNG storage and vaporization facilities.

Figure 9:
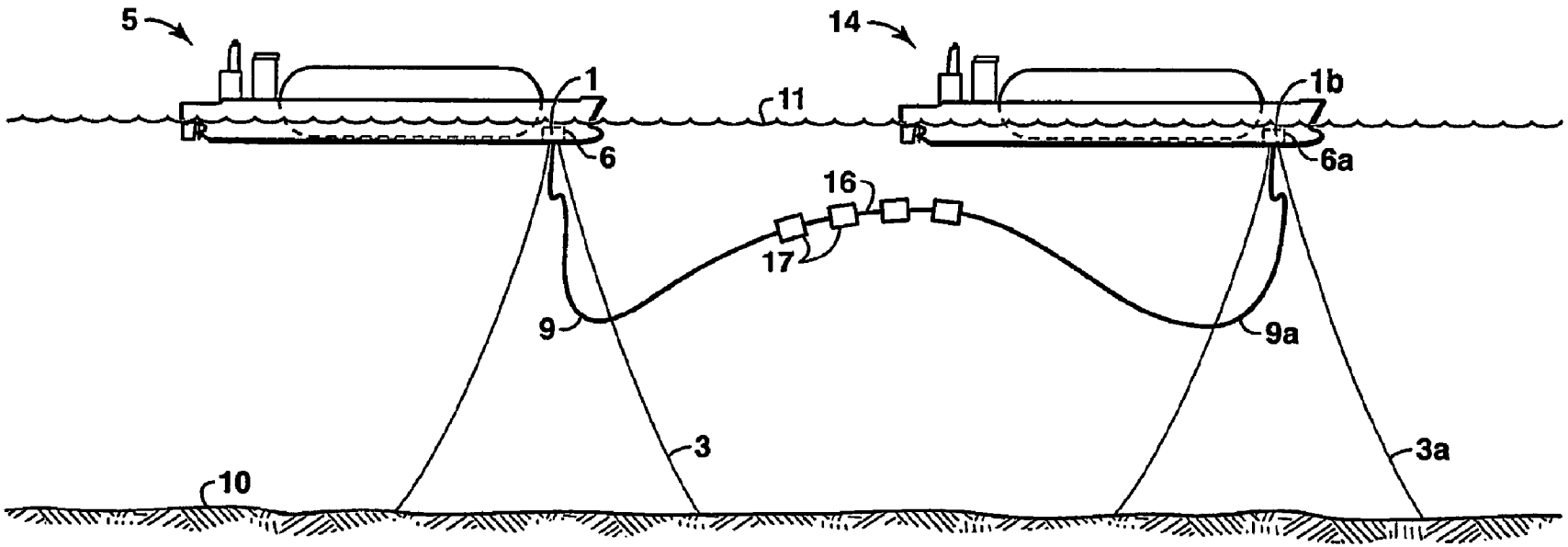
FIG. 9 depicts one embodiment of the invention including a submersible cryogenic turret connector-riser-pipeline system used to provide fluid communication between two floating vessels. In this embodiment buoyancy devices are used to suspend the pipeline at a mid-depth location in the body of water.

FIG. 9 depicts a mid-depth transfer embodiment of the invention. This embodiment may be used for moderate to deep water depths preferably but may also be used for shallower depths. Functionally, the concept is similar to the FSRU embodiment (FIG. 5); however, the cryogenic pipeline (or flowline) system is suspended at mid-depth in the water column to reduce costs and pressure drop across the system (versus risers extending to a pipeline on the ocean bottom). The depicted cryogenic pipeline (or flowline) system includes two cryogenic risers (9) and (9*a*) with first respective ends connected to and in fluid communication with respective submersible cryogenic turret connectors (1) and (1*b*) and second respective ends connected to opposite ends of a mid-depth cryogenic pipeline (16). The buoyancy of the cryogenic pipeline system is maintained by buoyancy cans (17) or other buoyancy devices known in the art. The mid-depth SLTS could be used with any of the previously described embodiments, and, for example, to transfer LNG from an LNG floating carrier vessel (5) to an FSRU, Floating LNG production system (FLNG) or another LNG floating carrier vessel.

The above-described embodiments of the invention may include a system for transporting a cryogenic fluid between a floating vessel and a second location and each embodiment may include one or more of the various alternatives described hereafter. The system may include a first cryogenic riser having a first end and a second end. The cryogenic riser is adapted for communicating a cryogenic fluid between the submersible cryogenic turret connector and the riser's second end. One end of the cryogenic riser may be near the surface of a body of water and connected to and in fluid communication with the submersible cryogenic turret connector and the second end of the riser may be connected to and in fluid communication with a pipeline located on the floor of the body of water or suspended at a mid-depth location. The second end of the first riser may be located in the body of water and in fluid communication with the second location. In one embodiment, the cryogenic riser is a flexible riser that has the ability to change the vertical distance between the endpoints of the riser. For example, the cryogenic riser may be made from a flexible hose or flexible pipe or the riser may be made from rigid pipe with articulating joints such that the vertical distance between the first end of the riser can be changed relative to the second end of the riser. The first riser may be adapted to allow the vertical position of the first end of the first riser to be changed. The system may alternatively include a riser where the second end of the first riser is not adapted to make changes in vertical position. The riser may include a plurality of cryogenic fluid conduits. The riser may alternatively include one or more cryogenic fluid conduits and one or more non-cryogenic fluid conduits.

Embodiments of the invention include a riser that is insulated. The riser may include a separate thermal insulating material on or within the riser. Alternatively, the riser may be constructed such that in operation it will act as a thermal insulating material. Thermal insulating materials include materials with a thermal conductivity of less than 12 W/m-° C. (7 Btu/hr-ft-° F.). Alternatively, the thermal insulating material may have a thermal conductivity less than 1.0 W/m-° C. (0.6 Btu/hr-ft-° F.) or less than 0.1 W/m-° C. (0.06 Btu/hr-ft-° F.). Exemplary insulating materials include mineral fibers, rubber, plastic foams (e.g. polyurethane foams, polyvinyl chloride foams, polystyrene foams), glass fibers, a vacuum, and/or microporous insulation such as aerogel.

Exemplary insulated risers include risers made of a pipe-in-pipe construction with any of the above mentioned insulating materials in the annulus between the pipes, a hose made in part of stainless steel wire, polymeric films and polymeric fabrics, polyurethane foam and rubber, a composite pipe made of stainless steel bellows, polypropylene armors, insulation and rubber. A riser may also be constructed and operated such that it is not made of or includes an insulating material, however, once placed in cryogenic service in a body of water, the riser becomes coated with ice which acts as an insulating material.

The system may include a first submersible turret connector connected to the first end of the first riser. The first connector may be adapted for releasably connecting to a first floating vessel located on the body of water so that a cryogenic fluid can be communicated between the first vessel and the first end of the first riser. The first connector may be adapted for connecting to the first vessel at a point below the surface of the body of water. Alternatively, the first connector may be adapted for connecting to the first vessel at a point above the surface of the body of water. The first connector may include a second fluid conduit in fluid communication with the first vessel. The first connector may include a plurality of fluid conduits in fluid communication with the first vessel. One or more of the fluid conduits may be cryogenic conduits. One or more of the fluid conduits may be suitable for non-cryogenic service. One or more of the conduits may be adapted for flow into the vessel, out of the vessel, or both into and out of the vessel.

The first connector may be moored to the bottom of the body of water so that the vertical position of the first connector can be changed. For example, the submersible cryogenic turret connector might be moored 30 meters below the surface of the body of water when not connected to a vessel and raised to a level within 10 or 20 meters of the surface, either above or below, of the body of water for connection to the vessel. Alternatively the submersible cryogenic turret connector could be moored 20, 40, or 50 meters or more below the surface of the body of water when not connected to a vessel. Alternatively, the submersible cryogenic turret connector could be allowed to fall to the floor of the body of water when not connected. As previously discussed, a messenger buoy may be connected to the submersible cryogenic turret connector by a mooring line.

The first connector may be adapted to allow the first vessel to rotate (i.e. weathervane) around the first connector upon the surface of the body of water while the first vessel is connected to the first connector.

The system may include a second submersible turret connector where the second connector is adapted for connecting to a second facility so that a fluid can be communicated between the first vessel and the second facility. The second connector may alternatively be adapted to allow the second facility to rotate around the second connector upon the surface of the body of water while the second facility is connected to the second connector. The second connector may alternatively be adapted for releasably connecting to the second facility. Alternatively, the second connector may be adapted for permanently connecting to the second facility. The second connector may be alternatively adapted to be moored to the bottom of the body of water so that the vertical position of the second connector can be changed.

The system may include a first cryogenic fluid conduit having a first end and a second end where the first end of the first conduit is in fluid communication with the second end of the first riser and the second end of the first conduit is in fluid communication with the second location. The first fluid conduit may be a pipeline conduit. The system may include a pipeline conduit where at least a portion of the pipeline conduit is insulated. Alternatively, the entire pipeline conduit may be insulated.

Embodiments of the invention include a pipeline conduit that is insulated. The riser may include a separate thermal insulating material on or within the pipeline. Alternatively, the pipeline may be constructed such that in operation it will act as a thermal insulating material. Exemplary insulating materials include mineral fibers, rubber, plastic foams (e.g. polyurethane foams, polyvinyl chloride foams, polystyrene foams), glass fibers, a vacuum, and/or microporous insulation such as aerogel. Exemplary insulated pipelines include pipelines made of a pipe-in-pipe construction with any of the above mentioned insulating materials in the annulus between the pipes, a hose made in part of stainless steel wire, polymeric films and polymeric fabrics, polyurethane foam and rubber, a composite pipe made of stainless steel bellows, polypropylene armors, insulation and rubber. A pipeline may also be constructed and operated such that it is not made of or includes an insulating material, however, once placed in cryogenic service in a body of water, the pipeline becomes coated with ice which acts as an insulating material.

The pipeline conduit may be at least partially submerged within the body of water. Alternatively, the pipeline conduit may be completely submerged within the body of water. The pipeline conduit may include a submerged pipeline having a first end and a second end where the first end of the pipeline is connected to the second end of the first riser and the second end of the pipeline is in fluid communication with the second location. The submerged pipeline may alternatively be located on or below the bottom of the body of water. The submerged pipeline may alternatively be suspended within the body of water. The suspended pipeline may include the use of buoyancy aids to assist the pipeline in remaining suspended. Exemplary buoyancy aids include buoyancy cans and other buoyancy aids known in the art.

The pipeline conduit may include a second riser having a first end and a second end where the first end is connected to the previously described second connector.

The first end of the pipeline conduit may be connected to the second end of the first riser, thereby forming a first pipeline connection. The first pipeline connection may include a manifold. The manifold may include shut-off valves.

The system may include a first riser that includes a first riser fluid conduit and a second riser fluid conduit. The first end of the first riser conduit and the first end of the second riser conduit may be attached to the first connector and the second end of the first riser conduit and the second end of the second riser conduit may be in fluid communication with the pipeline conduit. The system may further include a jumper fluid conduit. The jumper conduit may be adapted to provide a path for fluid communication between the first riser conduit and the second riser conduit. In alternative embodiments the jumper conduit may be located in the first connector, between the first and second riser conduits, in the pipeline end manifold, or between first and second pipeline conduits. If located in the first connector, the first connector may include two or more fluid conduits and the jumper conduit may be adapted to provide a fluid path between the fluid conduits located in the first connector. If located between the first and second riser conduits, the jumper conduit may be located anywhere along the length of the first and second riser conduits and adapted to provide a fluid path between first and second riser conduits. In one alternative the jumper conduit is located on the upper portions of the first and second riser conduits just below the first connector. In another alternative the jumper conduit is located on the lower portions of the first and second riser conduits just above where the first and second riser conduits connect to the pipeline conduit. Alternatively, the jumper conduit may be located in a pipeline end manifold, if present. If located between the first and second pipeline conduits, the jumper conduit may be located anywhere along the length of the first and second pipeline conduits and adapted to provide a fluid path between the first and second pipeline conduits. In one alternative the jumper conduit is located on the first riser side of the first and second pipeline conduits. In any of the above described locations the jumper conduit may be adapted to provide fluid communication between any one or more of the two or more fluid conduits in the first connector, between the first and second riser conduits, and/or between first and second pipeline conduits.

The system may include a pipeline conduit comprised of a first pipeline fluid conduit and a second pipeline fluid conduit. The first end of the first pipeline conduit may be in fluid communication with the second end of the first riser conduit. The first end of the second pipeline conduit may be in fluid communication with the second end of the second riser conduit. The second end of the first pipeline conduit and the second end of the second pipeline conduit may be in fluid communication with the second location. The overall system thereby providing a fluid conduit loop suitable for circulation of a cryogenic fluid.

The fluid conduit loop may be adapted to circulate a cryogenic fluid from the second location, through one of the first or second pipeline conduits, through one of the first or second riser conduits and the jumper conduit back to the second location through the other riser conduit, and through the other pipeline conduit while the first vessel is disconnected from the first connector.

The system may include a circulatory cryogenic fluid conduit submerged within the body of water where the circulatory fluid conduit has a first end connected to the first connector and in fluid communication with the first end of the first riser and second end in fluid communication with a point on the pipeline conduit, thereby providing a fluid conduit loop suitable for circulation of a cryogenic fluid. Alternatively, the second end of the circulatory cryogenic fluid conduit may be connected at the second location.

The pipeline conduit may include a splitter manifold where the splitter manifold has an inlet connected to a point on the pipeline conduit, a first outlet in fluid communication with the first connector, and a second outlet in fluid communication with an alternate submersible turret connector suitable for releasably connecting to a floating vessel located on the body of water.

The second location may include a facility. The facility may be a second floating vessel located on the body of water. Alternatively, the facility may be a land-based structure located on land. Whether a facility, a land-based structure or a floating vessel, the second location may be capable of processing and/or storing a fluid, preferably a cryogenic fluid. Processing a fluid may be selected from one or more of gasifying, regasifying, vaporizing, liquefying and/or transferring the fluid. In one alternative, the second location is capable of storing the fluid. In another alternative, the second location is capable of regasifying the fluid. In one alternative, the second location is a floating carrier vessel.

Alternatively, the first floating vessel may be located greater than 1 kilometer from the second location. Alternatively, the first floating vessel may be located greater than 1, 2, 3, 4 or 5 kilometers from the second location. Alternatively, the first floating vessel may be a floating vessel. Alternatively, the first floating vessel may be a floating cryogenic fluid storage vessel. Alternatively, the first floating vessel may be a floating carrier vessel.

The system may include a first riser, a first connector and a pipeline conduit that are adapted to transfer cryogenic fluids having a temperature below −50° C. (−58° F.). Alternatively, the riser, the first connector and the pipeline conduit may be adapted to transfer cryogenic fluids having a temperature below −100° C. (−148° F.). In alternative embodiments the cryogenic fluid is one or more of liquefied natural gas (LNG), pressurized liquefied natural gas (PLNG), liquefied petroleum gas (LPG), liquid nitrogen, or any other fluid at a cryogenic temperature. In alternate embodiments the cryogenic fluid is a hydrocarbon fluid. In alternative embodiments the cryogenic fluid includes greater than 50 weight percent methane. In alternative embodiments the cryogenic fluid includes greater than 75, 80, 85 or 90 weight percent methane.

The systems described herein may be used to transport a cryogenic fluid to land. The systems described herein may be used to vaporize at least a portion of the cryogenic fluid to produce a gas comprising greater than 50 weight percent methane. The systems described herein may be used to transport the vaporized gas to land.

Certain features of the present invention are described in terms of a set of numerical upper limits and a set of numerical lower limits. It should be appreciated that ranges formed by any combination of these limits are within the scope of the invention unless otherwise indicated. Although some of the dependent claims have single dependencies in accordance with U.S. practice, each of the features in any of such dependent claims can be combined with each of the features of one or more of the other dependent claims dependent upon the same independent claim or claims.

The present invention has been described in connection with its preferred embodiments. However, to the extent that the foregoing description is specific to a particular embodiment or a particular use of the invention, this is intended to be illustrative only and is not to be construed as limiting the scope of the invention. On the contrary, it is intended to cover all alternatives, modifications, and equivalents that are included within the spirit and scope of the invention, as defined by the appended claims.

We claim:

1. A system for transporting a cryogenic fluid between a floating vessel and a second location, comprising:

a) a first cryogenic riser having a first end and a second end, said first riser adapted to allow the vertical position of said first end of said first riser to be changed, said second end of said first riser located in a body of water and in fluid communication with said second location, at least a portion of said first riser being insulated; wherein said first riser includes a first riser fluid conduit and a second riser fluid conduit;

b) a first submersible turret connector connected to said first end of said first riser, said first connector adapted for releasably connecting to a first floating vessel located on said body of water so that a cryogenic fluid can be communicated between said first vessel and said first end of said first riser, said first connector being moored to the bottom of said body of water such that the vertical position of said first connector can be changed, and said first connector adapted to allow said first vessel to rotate around said first connector upon the surface of said body of water while said first vessel is connected to said first connector;

c) a pipeline cryogenic fluid conduit having a first end and a second end, said first end of said pipeline conduit in fluid communication with said second end of said first riser, said second end of said pipeline conduit in fluid communication with said second location, and said pipeline conduit at least partially submerged within said body of water; wherein at least a portion of said pipeline conduit is insulated; wherein a first end of said first riser conduit and a first end of said second riser conduit is attached to said first connector and a second end of said first riser conduit and a second end of said second riser conduit is in fluid communication with said pipeline conduit; and d) a jumper fluid conduit, said jumper conduit providing a path for fluid communication between said first riser conduit and said second riser conduit.

2. The system of claim 1, wherein said jumper fluid conduit is located in said first connector or between said first and second riser conduits.

3. The system of claim 1, wherein said pipeline conduit is comprised of a first pipeline fluid conduit and a second pipeline fluid conduit, a first end of said first pipeline conduit in fluid communication with said second end of said first riser conduit, a first end of said second pipeline conduit in fluid communication with said second end of said second riser conduit, a second end of said first pipeline conduit and a second end of said second pipeline conduit in fluid communication with said second location, thereby together with said jumper fluid conduit providing a fluid conduit loop suitable for circulation of a cryogenic fluid.

4. The system of claim 3, wherein said jumper fluid conduit is located in between said first and second pipeline conduits.

5. The system of claim 3, wherein said fluid conduit loop is adapted to circulate a cryogenic fluid from said second location, through said first and second pipeline conduits, said first and second riser conduits and said jumper conduit back to said second location while said first vessel is disconnected from said first connector.

6. The system of claim 1, wherein said first riser is adapted to changing the vertical distance between said first end and said second end of said first riser.

7. The system of claim 6, wherein said first riser is a flexible riser.

8. The system of claim 7, wherein said first riser includes one or more of a hose, rigid pipe, flexible pipe or articulating joints.

9. The system of claim 1, wherein said first connector is adapted for connecting to said first vessel at a point below the surface of said body of water.

10. The system of claim 1, wherein said first connector is adapted for connecting to said first vessel at a point above the surface of said body of water.

11. The system of claim 1, wherein said second location includes a facility.

12. The system of claim 11, wherein said facility is a second floating vessel located on said body of water.

13. The system of claim 11, wherein said facility is a land-based structure.

14. The system of claim 12, further including a second submersible turret connector, said second connector adapted for connecting to said second vessel so that a fluid can be communicated between said first vessel and said second vessel and said second connector adapted to allow said second vessel to rotate around said second connector upon the surface of said body of water while said second vessel is connected to said second connector.

15. The system of claim 14, wherein said second connector is adapted for releasably connecting to said second vessel.

16. The system of claim 15, wherein said second connector is moored to the bottom of said body of water so that the vertical position of said second connector can be changed.

17. The system of claim 1 wherein said first riser, said pipeline conduit, or both are insulated with a material having a thermal conductivity less than 1.0 W/m-° C. (0.6 Btu/hr-ft-° F.).

18. The system of claim 1, wherein said second end of said first riser conduit and said second end of said second riser conduit is connected to said first end of said pipeline conduit at a manifold.

19. The system of claim 1, wherein at least a portion of said pipeline conduit is located on or below the bottom of said body of water.

20. The system of claim 1, wherein said pipeline conduit is suspended within said body of water.

21. The system of claim 18, wherein said manifold includes shut-off valves.

22. The system of claim 1, wherein said pipeline conduit includes a splitter manifold, said splitter manifold having an inlet connected to a point on said pipeline conduit, a first outlet in fluid communication with said first connector, and a second outlet in fluid communication with an alternative submersible turret connector suitable for releasably connecting to a floating vessel located on said body of water.

23. The system of claim 1, further including a messenger buoy connected to said first connector.

24. The system of claim 1, wherein the vertical position of said first connector can be changed from a first position located within 20 meters of the surface of the body of water and a second position greater than 20 meters below the surface of the body of water.

25. The system of claim 1, wherein said first vessel is located greater than 1 kilometer from said second location.

26. The system of claim 1, wherein said first connector is a submerged turret loading connector or a submerged turret production connector.

27. The system of claim 1, wherein said first connector includes a plurality of fluid conduits.

28. The system of claim 27, wherein said first riser is comprised of a plurality of cryogenic fluid conduits.

29. The system of claim 1, wherein said first floating vessel is a floating cryogenic fluid storage vessel.

30. The system of claim 29, wherein said first floating vessel is a floating carrier vessel.

31. The system of claim 1, wherein said first riser, said first connector and said pipeline conduit are adapted to transfer cryogenic fluids having a temperature below −50° C. (−58° F.).

32. The system of claim 31, wherein said first riser, said first connector and said pipeline conduit are adapted to transfer cryogenic fluids having a temperature below −100° C. (−148° F.).

33. A system for transporting a cryogenic fluid between a floating vessel and a second location, comprising:

a) a first cryogenic riser having a first end and a second end, said first riser adapted to allow the vertical position of said first end of said first riser to be changed, said second end of said first riser located in a body of water and in fluid communication with said second location; wherein said first riser includes a first riser fluid conduit and a second riser fluid conduit;

b) a first submersible turret connector connected to said first end of said first riser, said first connector adapted for releasably connecting to a first floating vessel located on said body of water so that a cryogenic fluid can be communicated between said first vessel and said first end of said first riser, said first connector being moored to the bottom of said body of water such that the vertical position of said first connector can be changed, and said first connector adapted to allow said first vessel to rotate around said first connector upon the surface of said body of water while said first vessel is connected to said first connector;

c) a pipeline cryogenic fluid conduit having a first end and a second end, said first end of said pipeline conduit in fluid communication with said second end of said first riser, said second end of said pipeline conduit in fluid communication with said second location, said pipeline conduit at least partially submerged within said body of water; and d) a jumper fluid conduit, said jumper conduit providing a path for fluid communication between said first riser conduit and said second riser conduit;

wherein at least a portion of said first riser, at least a portion of said pipeline conduit, or both are insulated; wherein a first end of said first riser conduit and a first end of said second riser conduit is attached to said first connector and a second end of said first riser conduit and a second end of said second riser conduit is in fluid communication with said pipeline conduit.

34. The system of claim 33, wherein said jumper fluid conduit is located in said first connector or between said first and second riser conduits.

35. The system of claim 33, wherein said pipeline conduit is comprised of a first pipeline fluid conduit and a second pipeline fluid conduit, a first end of said first pipeline conduit in fluid communication with said second end of said first riser conduit, a first end of said second pipeline conduit in fluid communication with said second end of said second riser conduit, a second end of said first pipeline conduit and a second end of said second pipeline conduit in fluid communication with said second location, thereby together with said jumper fluid conduit providing a fluid conduit loop suitable for circulation of a cryogenic fluid.

36. The system of claim 35, wherein said jumper fluid conduit is located in between said first and second pipeline conduits.

37. The system of claim 35, wherein said fluid conduit loop is adapted to circulate a cryogenic fluid from said second location, through said first and second pipeline conduits, said first and second riser conduits and said jumper conduit back to said second location while said first vessel is disconnected from said first connector.

38. The system of claim 35, wherein said first riser is adapted to changing the vertical distance between said first end and said second end of said first riser.

39. The system of claim 38, wherein said first connector includes a plurality of fluid conduits.

40. The system of claim 39, wherein said first riser is comprised of a plurality of cryogenic fluid conduits.

41. A method of transporting a cryogenic fluid between a floating vessel and a second location, comprising:

a) communicating a cryogenic liquid through a cryogenic fluid transfer conduit between a first vessel and a second location, said cryogenic fluid conduit comprising:

i) a first cryogenic riser having a first end and a second end, said first riser adapted to allow the vertical position of said first end of said first riser to be changed, said second end of said first riser located in a body of water and in fluid communication with said second location, at least a portion of said first riser being insulated; wherein said first riser includes a first riser fluid conduit and a second riser fluid conduit;

ii) a first submersible turret connector connected to said first end of said first riser, said first connector adapted for releasably connecting to said first vessel located on said body of water so that said cryogenic fluid can be communicated between said first vessel and said first end of said first riser, said first connector being moored to the bottom of said body of water such that the vertical position of said first connector can be changed, and said first connector adapted to allow said first vessel to rotate around said first connector upon the surface of said body of water while said first vessel is connected to said first connector;

iii) a pipeline cryogenic fluid conduit having a first end and a second end, said first end of said pipeline conduit in fluid communication with said second end of said first riser, said second end of said pipeline conduit in fluid communication with said second location, and said pipeline conduit at least partially submerged within said body of water; wherein at least a portion of said pipeline conduit is insulated; wherein a first end of said first riser conduit and a first end of said second riser conduit is attached to said first connector and a second end of said first riser conduit and a second end of said second riser conduit is in fluid communication with said pipeline conduit; and iv) a jumper fluid conduit, said jumper conduit providing a path for fluid communication between said first riser conduit and said second riser conduit.

42. The method of claim 41, wherein said jumper fluid conduit is located in said first connector or between said first and second riser conduits.

43. The method of claim 41, wherein said pipeline conduit is comprised of a first pipeline fluid conduit and a second pipeline fluid conduit, a first end of said first pipeline conduit in fluid communication with said second end of said first riser conduit, a first end of said second pipeline conduit in fluid communication with said second end of said second riser conduit, a second end of said first pipeline conduit and a second end of said second pipeline conduit in fluid communication with said second location, thereby together with said jumper fluid conduit providing a fluid conduit loop suitable for circulation of a cryogenic fluid.

44. The method of claim 43, wherein said jumper fluid conduit is located in between said first and second pipeline conduits.

45. The method of claim 43, wherein said fluid conduit loop is adapted to circulate a cryogenic fluid from said second location, through said first and second pipeline conduits, said first and second riser conduits and said jumper conduit back to said second location while said first vessel is disconnected from said first connector.

46. The method of claim 41, wherein said first riser is adapted to changing the vertical distance between said first end and said second end of said first riser.

47. The method of claim 46, wherein said first riser is a flexible riser.

48. The method of claim 47, wherein said first riser includes one or more of a hose, rigid pipe, flexible pipe or articulating joints.

49. The method of claim 41, wherein said first connector is adapted for connecting to said first vessel at a point below the surface of said body of water.

50. The method of claim 41, wherein said first connector is adapted for connecting to said first vessel at a point above the surface of said body of water.

51. The method of claim 41, wherein said second location includes a facility.

52. The method of claim 51, wherein said facility is a second floating vessel located on said body of water.

53. The method of claim 51, wherein said facility is a land-based structure.

54. The method of claim 51, wherein at least a portion of said pipeline conduit is located on or below the bottom of said body of water.

55. The method of claim 51, wherein said pipeline conduit is suspended within said body of water.

56. The method of claim 41, wherein the vertical position of said first connector can be changed from a first position located within 20 meters of the surface of the body of water and a second position greater than 20 meters below the surface of the body of water.

57. The method of claim 41, wherein said first vessel is located greater than 1 kilometer from said second location.

58. The method of claim 41, wherein said first connector includes a plurality of fluid conduits.

59. The method of claim 41, wherein said first riser further is comprised of a plurality of cryogenic fluid conduits.

60. The method of claim 41, wherein said first floating vessel is a floating cryogenic fluid storage vessel.

61. The method of claim 60, wherein said first floating vessel is a floating carrier vessel.

62. The method of claim 41, wherein said cryogenic fluid includes greater than 50 weight percent methane.

63. The method of claim 62, wherein said cryogenic fluid has a temperature below −50° C. (−58° F.).

64. The method of claim 63, wherein said cryogenic fluid has a temperature below −100° C. (−148° F.).

65. The method of claim 62, further comprising transporting said cryogenic fluid to land.

66. The method of claim 62, further comprising vaporizing at least a portion of said cryogenic fluid to produce a gas comprising greater than 50 weight percent methane.

67. The method of claim 66, further comprising transporting said gas to land.

68. A method of transporting a cryogenic fluid between a floating vessel and a second location, comprising:

a) communicating a cryogenic liquid through a cryogenic fluid transfer conduit between a first vessel and a second location, said cryogenic fluid conduit comprising:

i) a first cryogenic riser having a first end and a second end, said first riser adapted to allow the vertical position of said first end of said first riser to be changed, said second end of said first riser located in a body of water and in fluid communication with said second location, wherein said first riser includes a first riser fluid conduit and a second riser fluid conduit;

ii) a first submersible turret connector connected to said first end of said first riser, said first connector adapted for releasably connecting to said first vessel located on said body of water so that said cryogenic fluid can be communicated between said first vessel and said first end of said first riser, said first connector being moored to the bottom of said body of water such that the vertical position of said first connector can be changed, and said first connector adapted to allow said first vessel to rotate around said first connector upon the surface of said body of water while said first vessel is connected to said first connector;

iii) a pipeline cryogenic fluid conduit having a first end and a second end, said first end of said pipeline conduit in fluid communication with said second end of said first riser, said second end of said pipeline conduit in fluid communication with said second location, said pipeline conduit at least partially submerged within said body of water; wherein a first end of said first riser conduit and a first end of said second riser conduit is attached to said first connector and a second end of said first riser conduit and a second end of said second riser conduit is in fluid communication with said pipeline conduit; and iv) a jumper fluid conduit, said jumper conduit providing a path for fluid communication between said first riser conduit and said second riser conduit:

wherein at least a portion of said first riser, at least a portion of said pipeline conduit, or both are insulated.

69. The method of claim 68, wherein said jumper fluid conduit is located in said first connector or between said first and second riser conduits.

70. The method of claim 68, wherein said pipeline conduit is comprised of a first pipeline fluid conduit and a second pipeline fluid conduit, a first end of said first pipeline conduit in fluid communication with said second end of said first riser conduit, a first end of said second pipeline conduit in fluid communication with said second end of said second riser conduit, a second end of said first pipeline conduit and a second end of said second pipeline conduit in fluid communication with said second location, thereby together with said jumper fluid conduit providing a fluid conduit loop suitable for circulation of a cryogenic fluid.

71. The method of claim 70, wherein said jumper fluid conduit is located in between said first and second pipeline conduits.

72. The method of claim 70, wherein said fluid conduit loop is adapted to circulate a cryogenic fluid from said second location, through said first and second pipeline conduits, said first and second riser conduits and said jumper conduit back to said second location while said first vessel is disconnected from said first connector.

73. The method of claim 68, wherein said first riser is adapted to changing the vertical distance between said first end and said second end of said first riser.

74. The method of claim 68, wherein said first riser is a flexible riser.

75. A method of transporting a cryogenic fluid between a first location and a floating vessel located on a body of water, comprising:

a) connecting a first floating vessel to a first submersible turret connector, said first connector adapted for releasably connecting to said first floating vessel so that a cryogenic fluid can be communicated between said first floating vessel and said first connector, said first connector being moored to the bottom of said body of water such that the vertical position of said first connector can be changed, and said first connector adapted to allow said first floating vessel to rotate around said first connector upon the surface of said body of water while said first floating vessel is connected to said first connector;

b) communicating a cryogenic fluid between said first floating vessel and said first connector;

c) communicating said cryogenic fluid between said first connector and a first cryogenic riser having a first end and a second end, said first end of said first riser connected to said first connector, said second end of said first riser located in a body of water and in fluid communication with said first location, and said first riser adapted to allow the vertical position of said first end of said first riser to be changed, wherein said first riser includes a first riser fluid conduit and a second riser fluid conduit;

d) communicating said cryogenic fluid between said first riser and a pipeline cryogenic fluid conduit having a first end and a second end, said first end of said pipeline conduit in fluid communication with said second end of said first riser, said second end of said pipeline conduit in fluid communication with said first location, and said pipeline conduit at least partially submerged within said body of water; wherein a first end of said first riser conduit and a first end of said second riser conduit is attached to said first connector and a second end of said first riser conduit and a second end of said second riser conduit is in fluid communication with said pipeline conduit; and e) communicating said cryogenic fluid from said first location to said first submersible turret connector, through a jumper fluid conduit, and back to said first location when cryogenic fluid is not communicating between said first floating vessel and said first connector, wherein said jumper conduit provides a path for fluid communication between said first riser conduit and said second riser conduit.

76. The method of claim 75, wherein said first location includes a facility.

77. The method of claim 76, wherein said cryogenic fluid is communicated from said first floating vessel to said facility.

78. The method of claim 76, wherein said cryogenic fluid is communicated from said facility to said first floating vessel.

79. The method of claim 78, further including:

e) disconnecting said first floating vessel from said first connector; and f) transporting said cryogenic fluid over said body of water on said first floating vessel to a third location.

80. The method of claim 79, further including:

g) vaporizing said cryogenic fluid to a gas.

* * * * *